US012546042B2

(12) United States Patent
Mathews et al.

(10) Patent No.: US 12,546,042 B2
(45) Date of Patent: Feb. 10, 2026

(54) TUFTING MACHINES AND METHODS OF TUFTING

(71) Applicant: Card-Monroe Corp., Chattanooga, TN (US)

(72) Inventors: Ricky E. Mathews, Sale Creek, TN (US); William M. Christman, Jr., Chattanooga, TN (US); Brian Lovelady, Soddy Daisy, TN (US); Jamie Vetter, Soddy Daisy, TN (US)

(73) Assignee: Card-Monroe, Corp., Chattanooga, TN (US)

( * ) Notice: Subject to any disclaimer, the term of this patent is extended or adjusted under 35 U.S.C. 154(b) by 0 days.

(21) Appl. No.: 18/955,318

(22) Filed: Nov. 21, 2024

(65) Prior Publication Data

US 2025/0084574 A1 Mar. 13, 2025

Related U.S. Application Data

(63) Continuation of application No. 18/235,917, filed on Aug. 21, 2023, now Pat. No. 12,180,632.

(60) Provisional application No. 63/401,393, filed on Aug. 26, 2022.

(51) Int. Cl.

| | |
|---|---|
| ***D05C 15/36*** | (2006.01) |
| ***D05C 15/10*** | (2006.01) |
| ***D05C 15/28*** | (2006.01) |
| ***D05C 15/34*** | (2006.01) |

(52) U.S. Cl.

CPC ..... *D05C 15/36* (2013.01); *D05C 15/10* (2013.01); *D05C 15/28* (2013.01); *D05C 15/34* (2013.01)

(58) Field of Classification Search

CPC ..... D05C 15/14; D05C 15/18; D05C 15/24; D05C 15/28; D05C 15/32; D05C 15/34; D05C 15/36

See application file for complete search history.

(56) References Cited

U.S. PATENT DOCUMENTS 3,160,125 A * 12/1964 Payne ..... D03D 39/06 112/80.43
3,217,675 A * 11/1965 Short ..... D05C 15/18 112/80.08
3,217,676 A * 11/1965 Short ..... D05C 15/20 112/222
3,336,889 A * 8/1967 Short ..... D05C 15/00 112/475.08

(Continued)

*Primary Examiner* — Danny Worrell

(74) *Attorney, Agent, or Firm* — Adams & Reese LLP; D. Scott Sudderth

(57) ABSTRACT

A system, apparatus and methods for forming tufted articles can include a hollow needle tufting machine for forming patterned tufted articles including multiple colors of yarns. The hollow needle tufting machine can include a series of hollow needles arranged along a needle bar at a gauge spacing and will receive a series of different color and/or types of yarns from a yarn feed system. A funnel block having a series of funnels configured to receive a series of yarns will be provided adjacent the needle bar for directing selected yarns to a corresponding or associated hollow needle. The hollow needles will be reciprocated into and out of a backing to deliver a series of yarns; and can be engaged by corresponding knives to form tufts of yarns. The knives can be moved between no-cut and cutting positions to form loop and cut pile tufts of yarns in the backing.

20 Claims, 21 Drawing Sheets

(56) References Cited

U.S. PATENT DOCUMENTS 3,356,049 A * 12/1967 Short ..... D05C 15/20 112/222
3,361,095 A * 1/1968 Short ..... D05C 15/00 112/260
3,386,403 A * 6/1968 Short ..... D05C 15/26 112/80.71
3,396,687 A * 8/1968 Nowicki ..... D05C 15/20 112/80.4
3,430,590 A * 3/1969 Looper ..... D05C 15/00 112/80.04
3,595,185 A * 7/1971 Shorrock ..... D05C 15/18 112/80.08
3,881,432 A * 5/1975 Dodd ..... D05C 15/32 112/221
3,986,465 A * 10/1976 Smith ..... D05C 15/14 112/80.32
4,062,308 A * 12/1977 Spanel ..... D05C 15/18 226/113
4,549,496 A * 10/1985 Kile ..... D05C 15/34 112/80.08
4,991,523 A * 2/1991 Ingram ..... D05C 15/24 112/80.08
5,080,028 A * 1/1992 Ingram ..... D05C 15/18 112/80.08
5,158,027 A * 10/1992 Ingram ..... D05B 29/06 112/235
5,165,352 A * 11/1992 Ingram ..... D05C 15/34 112/80.08
5,182,997 A * 2/1993 Bardsley ..... D05C 15/18 112/302
5,205,233 A * 4/1993 Ingram ..... D05C 15/28 114/294
5,267,520 A * 12/1993 Ingram ..... D05C 15/28 112/410
5,467,724 A * 11/1995 Bardsley ..... D05C 15/18 112/80.7
5,562,056 A * 10/1996 Christman, Jr. ..... D05C 15/32 112/80.33
5,588,383 A * 12/1996 Davis ..... D05C 15/24 112/80.16
5,738,030 A * 4/1998 Ok ..... D05C 15/34 112/80.23
5,743,201 A * 4/1998 Card ..... D05C 15/18 112/80.73
5,983,815 A * 11/1999 Card ..... D05C 15/18 112/80.73
6,155,187 A * 12/2000 Bennett ..... D05C 15/24 112/80.51
6,202,580 B1 * 3/2001 Samilo ..... D05C 15/24 112/80.73
6,273,011 B1 * 8/2001 Amos ..... D05C 15/34 112/222
6,293,211 B1 * 9/2001 Samilo ..... D05C 15/32 112/80.23
6,401,639 B1 * 6/2002 Samilo ..... D05C 15/18 112/80.73
6,712,014 B2 * 3/2004 Mamiya ..... D05B 21/00 112/261
7,318,383 B1 * 1/2008 Ingram ..... D05C 15/14 112/80.4
8,161,896 B1 * 4/2012 Ingram ..... D05B 85/00 112/80.08
8,181,585 B1 * 5/2012 Samilo ..... D05C 15/08 112/80.01
8,225,727 B2 * 7/2012 Wilson ..... D05C 15/24 112/80.71
8,413,597 B1 * 4/2013 Samilo ..... D05C 15/20 112/80.16
8,443,743 B2 * 5/2013 Christman, Jr. ..... D05C 15/34 112/80.23
9,085,840 B2 * 7/2015 Payne ..... D05B 53/00
10,156,935 B2 * 12/2018 Lee ..... G06F 3/0418
10,961,647 B2 * 3/2021 Amos ..... D05C 17/026
10,995,442 B2 * 5/2021 Hall ..... D05C 15/32
11,661,694 B2 * 5/2023 Detty ..... D05C 15/22 112/475.07
2002/0078871 A1 * 6/2002 Mamiya ..... D05B 19/12 112/475.04
2006/0137581 A1 * 6/2006 Mile ..... D05C 15/18 112/80.05
2014/0331906 A1 * 11/2014 Hall ..... D05C 15/08 112/80.23
2016/0289880 A1 * 10/2016 Hall ..... D05C 15/32
2017/0356113 A1 * 12/2017 Amos ..... D05C 17/026
2023/0175182 A1 * 6/2023 Pongrass ..... D05C 15/20 112/80.23
2024/0068144 A1 * 2/2024 Mathews ..... D05C 15/36

* cited by examiner

TUFTING MACHINES AND METHODS OF TUFTING

CROSS-REFERENCE

The present Patent Application is a Continuation of U.S. patent application Ser. No. 18/235,917, filed Aug. 21, 2023, and claims the benefit of U.S. Provisional Patent Application No. 63/401,393, filed Aug. 26, 2022.

INCORPORATED BY REFERENCE

The disclosure and figures of U.S. patent application Ser. No. 18/235,917, filed Aug. 21, 2023 and U.S. Provisional Patent Application No. 63/401,393, filed Aug. 26, 2022 are specifically incorporated by reference herein as if set forth in their entireties.

TECHNICAL FIELD

The present disclosure relates to tufting machines for producing tufted textile goods such as carpet, and other articles; and more particularly to hollow needle tufting machines and methods of tufting utilizing such hollow needle tufting machines.

BACKGROUND

Hollow needle tufting machines, such as illustrated in Kile, U.S. Pat. No. 4,549,496, Davis et al., U.S. Pat. No. 5,588,383, and Samilo, U.S. Pat. No. 6,401,639, have been used to produce patterned carpets by implanting different colors of yarns into a backing material. Such hollow needle tufting machines typically have a yarn feed mechanism that supplies yarns of different colors to each of the hollow needles, the yarns being blown into and through a funnel block associated with each hollow needle and into a central passage of each hollow needle. Conventionally, solenoid controlled air cylinders are operated to control feeding of the different colors of yarns through the funnels and to each of the hollow needles. In the past, the number of colors that could be fed to each needle of such hollow needle tufting machines generally has been limited by the gauge spacing, and to expand the number of colors, it has been typical to increase the gauge spacing between the needles, e.g., doubling the spacing from 1" to 2", which can lead to other limitations in terms of the patterns produced and/or the production rates of the machines.

In addition, many conventional hollow needle tufting machines include a plurality of injectors and one or more solenoid valves for each needle, which adds to the complexity and expense of the manufacture, maintenance and repair, and operation of such hollow needle tufting machines; often increasing the amounts of energy used by the machines as needed to supply additional air thereto during operation of the machines. It also is desirable to control the feeding of the yarns to try to achieve as close to a uniform pile height as possible. However, when yarns are changed and released from the needles, the yarns can retract due to the inherent elasticity of the respective yarns, which contraction can vary for different yarns having differing elasticities.

Thus, it may be seen that there exists a need for hollow needle tufting machines able to achieve increases in production efficiency and the ability to produce intricate patterns, such as patterns utilizing increased numbers of colors of yarns. The present disclosure is directed to hollow needle tufting machines and methods for operating such hollow needle tufting machines that address the foregoing and other needs and drawbacks existing in the art.

SUMMARY

Briefly described, the present disclosure is directed to a system, apparatus and methods for forming tufted articles, for example and without limitation, carpets, artificial turf and/or grass, rugs, and other tufted fabrics.

In embodiments, the systems and apparatus for forming tufted articles disclosed and illustrated herein can include a tufting machine having a series of needles that are reciprocated into and out of a backing to form a plurality of tufts therein. In embodiments, the tufting machine can further comprise a yarn feed system feeding a plurality of yarns to each of the needles, and a yarn selection system including a plurality of jerker modules each having a cylinder body and a jerker moveable between extended and retracted positions for pulling back non-selected yarns from the needles. In some embodiments, the jerker modules can comprise double acting cylinders having a reduced profile and can further comprise multi-way valves for controlling a flow of pressurized air to control extension and retraction of the jerkers. In embodiments, the yarn feed system can include a plurality of yarn feed devices, each yarn feed device configured to feed a single yarn to associated ones of the hollow needles.

In some embodiments, the apparatus can comprise a tufting machine having a plurality of hollow needles, a yarn feed system, a yarn selection system, a yarn cutting system; and a control system having one or more processors and programming configured to cooperatively control the feeding of yarns to the hollow needles by the yarn feed system, engagement of one or more jerkers of the yarn selection system to pull back non-selected yarns, and/or movement of one or more knives of the yarn cutting system to cut the selected yarns presented by the needles, to form a selected pattern.

In addition, in embodiments, the methods disclosed and illustrated herein can include a method of forming patterned tufted articles. In embodiments, the method can comprise shifting a plurality of hollow needles in gauge increments. In some embodiments, the method can further comprise selectively moving one or more knives between a non-engaging or no-cut position and one or more engaging or cutting positions.

In embodiments, the present disclosure is directed to an improved hollow needle tufting machine and features and/or components thereof. The improved hollow needle tufting machine may include a control system having a controller that can be incorporated with the hollow needle tufting machine. The control system can include instructions or programming that can be executed to control the various operative systems or components of the hollow needle tufting machine in a cooperative manner to form patterns using an increased number of colors or types of yarns, which patterns can be formed without having to expand the gauge spacing between the needles. For example, and without limitation, in embodiments, patterned articles including 4, 8, 16, and possibly more colors of yarns can be formed, with the hollow needles of the hollow needle tufting machine arranged at a gauge spacing of approximately 1", and with a substantially consistent feeding of yarns to each of the needles.

For example, in embodiments, a hollow needle tufting machine is disclosed that can include a needle bar having a series of hollow needles mounted in spaced series, such as at an exemplary gauge spacing of approximately 1" (and in some embodiments, a gauge spacing of less than 1" or a gauge spacing of greater than 1"). The needle bar can be mounted along a mounting plate that can include or can be coupled to a funnel block having a series of funnels, each associated with a corresponding one of the needles. Each funnel, in some embodiments, can be configured to enable at least about 8 colors to be fed therethrough and to each of the hollow needles. For example, in embodiments, each needle can tuft up to about 8 colors per needle. The yarns can be fed from an upper or inlet portion of each funnel to a tubular outlet that, in embodiments, can have a stop defined therealong.

In embodiments, the inlet portion of each funnel can be configured as a multi-angle circular orifice having a first angled or beveled surface defined adjacent an upper portion or region of the funnel and having a first angle, and which transitions to a second angled surface that has a second angle that, in embodiments, can be different from the first angle. The yarns are guided into and through the funnel, to the tubular outlet of the funnel and into the bore of a corresponding or associated hollow needle located therebelow.

In other embodiments, the funnel can have a plurality of fluted yarn flow grooves defined about the circumference thereof adjacent its upper portion or region. For example, in embodiments, the funnel can include 8 fluted yarn flow grooves. In other embodiments, greater or lesser numbers of fluted yarn flow grooves also can be provided. In embodiments, the fluted yarn flow grooves can be arranged about the funnel in a substantially circular arrangement, e.g., configured so as to form a flower-pot type design. It is contemplated that other arrangements also can be used in other embodiments, as needed, to accommodate different numbers and/or types of yarns being fed. In embodiments, each funnel can be configured to feed more than one yarn per flute.

In embodiments, the hollow needle tufting machine can include a modular configuration of needles and knives. For example, in embodiments, a plurality of needle modules, each including one or more hollow needles, can be mounted along the needle bar of the hollow needle tufting machine. In some embodiments, the needles can be located and secured in place, and at a desired orientation, within their modules by a tooling jig. In embodiments, the tooling jig can include a body having openings in which the needles are received and against which the needle modules can be engaged. The openings in the jig guide the needles into a desired orientation after which each needle can be fixed in place in the body of its module. In addition, in embodiments, a plurality of knife modules can be provided, for example, as part of a yarn cutting system or knife bar system, with each knife module having at least one knife or cutting blade.

In embodiments, a shift mechanism can be provided to control a shifting movement of a backing support or shuttle of the hollow needle tufting machine. In embodiments, a shift mechanism further can be provided for shifting the needle bar, and thus the needles, in steps transversely across the backing material. In optional embodiments, the backing can be shifted or the needle bar can be shifted transversely, or both the backing and needle bar can be shifted transversely. The shift mechanisms can include servo motor driven or similar actuator driven shift mechanisms, which can include, in embodiments, a servo controlled rack and pinion shift mechanism.

In embodiments, the needle modules can be provided with a reduced profile such that the needles can be mounted at about 1" gauge spacings, with each needle receiving about 8 color yarns. It is contemplated that other desired gauge spacings of the needles can be used by shifting the backing, shifting the needles or both, additional colors can be tufted. The needles also can be mounted at a closer spacing. The backing, the needles, or both can be shifted laterally in single or double gauge jumps or steps transversely as needed to form selected patterns, rather than having to shift multiple gauges across two, three, or more needle gauge spacings to form the same patterns.

In embodiments, the hollow needle tufting machine can incorporate a yarn feed system with improved control. For example, in embodiments, the hollow needle tufting machine can incorporate one or more single or double end yarn feed mechanisms or attachments, such as an Infinity™ or Infinity IIE™ yarn feed attachment or yarn feed mechanism or system from Card-Monroe Corp. of Chattanooga, TN. Such yarn feed mechanisms or attachments can comprise yarn feed units or modules that each can include a plurality of individual yarn feed devices that can be individually selectively controlled for feeding one or two yarns, or in some embodiments, more yarns to the needles. In embodiments, the one or more yarn feed mechanisms or attachments of the yarn feed system generally can be configured to control feeding of selected lengths of yarn per individual stitches to enable formation of multiple fabric surfaces and/or multiple fabric pile heights.

In addition, in embodiments, the hollow needle tufting machine can include puller rolls downstream from the yarn feed mechanisms and/or attachments on each side of the hollow needles tufting machine. The rotation of the puller rolls can be controlled by the system control to control pulling of the yarns from the yarn feed rolls of the one or more yarn feed mechanisms or attachments, for feeding along a path of travel to their needles.

In some embodiments, the hollow needle tufting machine further can comprise a yarn selection system. In embodiments, the yarn selection system can comprise a series of injectors operable to inject air into the funnels so as to blow or direct selected yarns fed from the yarn feed system into the needles. In some embodiments, the yarn selection system further can include a series of jerker modules arranged along a path of travel of the yarns from the yarn feed mechanism(s) or attachment(s) to the needles, each jerker module generally having a yarn jerker coupled to an actuator. The yarn jerkers can be selectively controlled to extend and retract along a selected length or travel (e.g., in embodiments, an approximately 2" travel, though other distances also can be used) to retract or pull back yarns from the needles. In embodiments, this can enable the use of smaller needles and modules that can be arranged at closer spacings (e.g., on 1" gauge spacings).

In embodiments, the actuators can include air cylinders formed with or incorporated into the jerker modules, e.g., the jerker modules can be formed with a plurality of bores each receiving a piston rod therein. Other types of actuators also can be provided. For example, in some embodiments, the jerker modules (or the actuators thereof) can comprise double acting air cylinders configured without a mechanical spring return, and using air supplied to different portions of bores of the jerker modules to cause selective movement of the pistons along the bores so as to control extension and retraction of the jerkers. Providing or forming the jerkers modules as double acting cylinders can, in embodiments, help increase a timing or speed of actuation of the yarn jerkers due to no spring being used. In addition, lower air pressure for operation of the yarn jerkers also can be utilized to operate the double acting cylinders.

In embodiments, the actuators (e.g., the jerker modules/double acting cylinders or other selectively controlled actuators) can be reduced in size. For example, the jerker modules could be reduced from ½ to 5/16 bore with two four way solenoid valves and two three way valves. The jerker modules also can be configured with a smaller profile to enable enhanced density of design (e.g., eight jerker modules located in a spacing of about two inches) which high density module arrangement allows control of the feeding and/or pulling back of unused yarns to from the needle (e.g., using a 2" travel jerker).

In embodiments, each of the yarn jerkers can include a body with a proximal end configured to engage a yarn passing through the yarn selection system, e.g., through openings in a yarn guide adjacent the jerker module, and a key, e.g., a female or a male keyway, at a distal end thereof. The keys can couple the jerkers to associated ones of the actuators by engagement and interlocking with jerker gates, which interlocking arrangement can be configured to restrict rotation thereof. In further embodiments, guide rods can be used as an alternative anti-rotation mechanism.

The jerker modules also can be formed of a lighter weight material, such as aluminum or a composite material, e.g., nylon, carbon fiber polymers, and/or other moldable materials. In some embodiments, the yarn feed openings formed in the jerker modules also could be hard coat anodized or otherwise treated to facilitate movement of the yarns therethrough. Individual tubes or conduits for each yarn can be coupled to the yarn feed openings to supply yarns through the yarn jerker modules and to the needles for forming tufts in the backing.

In embodiments, the yarn feed system can be controlled, such as by a control system based on programming and a desired pattern being formed. In some embodiments, the control system can include a controller that can include one or more processors and a memory that can be configured to receive and store pattern information, and further can include programming or instructions adapted to control operation of the hollow needle tufting machine and the various operative components thereof. For example, in embodiments, the controller of the control system can include programming or instructions executed by the one or more processors for selectively controlling the yarns fed to the needles to enable substantially consistent yarn feeding to each of the needles, in cooperation with the engagement/selective operation of the knives and yarn jerkers, and/or shifting of the backing material and/or needles based on received or programmed pattern information to form a desired pattern with multiple color and/or types of yarns.

In such embodiments, the control system can include programming adapted to apply dynamic advance parameters to advance operation of various operative components of the hollow needle tufting machine based on an operating speed (RPM) of the main shaft of the hollow needle tufting machine. For example, the control system can advance operation of one or more operative components, such as engaging selected ones of the yarn jerkers, engagement (e.g., turning on and off) of the air blower(s), yarn feed of selected ones of the yarns being fed to each needle, movement of the knives between cutting and non-engaging or no cut positions, shifting and other operative elements, in advance of a next stitch or tuft placement step for the pattern, based on rotation of the machine shaft of the tufting machine.

In embodiments, the control system can control the yarn feed system (e.g., control selected ones of the yarn feed devices or the yarn feed mechanisms or units thereof) to deliver portions of the lengths of yarns to be fed to each needle during each stitch or individual sewing operation within a portion of the revolution of a main shaft of the hollow needle tufting machine.

The hollow needle tufting machine can be configured, in some embodiments, to provide single level cut-pile tufted fabrics, and the control system can include programming, which can utilize yarn feed control to control formation of multi-level loop pile tufts of yarns, without necessarily requiring movement of knives for cutting loops of yarns from a cut (cylinder extended) position to a loop (cylinder retracted) position.

In some additional embodiments, formation of multi-level pile height tufts, which can include formation of two level cut-pile tufts, also can be provided. In such embodiments, yarn feed control can be utilized in conjunction with a yarn cutting or knife system that is configured to enable increased control of the positioning of the knives, including selective movement of selected knives in accordance with a tufted pattern to be formed can be provided.

For example, in some embodiments, the yarn cutting or knife bar system can include a knife bar along which a series of knives are mounted. In embodiments, the yarn cutting or knife system further can include a knife bar with a plurality of individually controllable knife modules or blocks mounted therealong. Each knife module or block can have a body in which a knife is mounted, and a multi-position actuator such as an air cylinder that can be controlled or fired selectively to move its corresponding or associated knife between no-cut and cutting positions in relationship to a stroke of the needles of the hollow needle tufting machine.

In embodiments, the knives can be orientated or aligned to a desired or selected position with respect to the needles by an alignment system, which, in embodiments, can include a plate assembly arranged along the knife bar. In embodiments, the knives can be oriented by the plate assembly to set an angle of the orientation of the knives with respect to a needle angle of each of their associated or corresponding needles. The adjustment of the knives also can assist in setting or adjusting knife pressure.

By selectively controlling the knife position, multiple cutting heights can be achieved. As a further result, in embodiments, the yarn feed can be controlled in conjunction with the control of the knives positioning to enable formation of multiple pile height tufted articles having both cut and loop piles. In some embodiments, the multiple pile height tufts can include different pile height cut pile tufts and different pile height loop pile tufts that can be selectively formed to enable further texturing effects, in addition to enabling various patterns of different colors or types or yarns to be formed.

In embodiments, a knife positioning system is disclosed wherein a muti-position actuator can be provided. Air pressure of a flow or supply of air, or other fluid, to the multi-position actuators can be controlled by the control system to move the knives between various selected cutting positions to form cut pile tufts of selected pile heights, and a non-engaging or no cut position to form loop pile tufts. For example, in embodiments, the multi-position actuator can include a 3-position actuator such as a 3-position pneumatic or hydraulic cylinder or a servo or stepper motor (or other actuator), and further can include a 4-way fluid valve for selectively controlling a supply of fluid (e.g., air) to the 3-position actuator. In embodiments, at least three positions for each of the knives can be provided, e.g., a high cut position, low cut position, and a no cut or loop position.

In addition, according to various aspects of the disclosure, a tufting machine is provided, comprising: a backing support; a plurality of needles positioned above the backing support and configured to penetrate a backing positioned on the backing support upon reciprocation of the needles; wherein the needles comprise hollow needles, each having an upper end and a lower end, with a passage defined between the upper and lower ends; a yarn feed system for supplying a plurality of yarns; a series of funnels in communication with the needles; a yarn selection system coupled to an air supply and configured to deliver selected yarns of the yarns supplied by the yarn feed system to one or more of the needles; wherein the yarn selection system comprises: a series of injectors configured to direct the selected yarns to the needles into one or more of the funnels for feeding to the needles; a series of jerker modules arranged along a path of travel of the yarns from the yarn feed system to the funnels, each of the jerker modules in communication with the air supply and including a plurality of bores with pistons received therein; and a plurality of jerkers coupled to the pistons and each comprising a body having a proximal end and a distal end configured to engage at least one of the yarns supplied by the yarn feed system; wherein the jerkers are individually moveable between an extended position and a retracted position to retract non-selected yarns from the funnels by selective control of air flows to the bores of the jerker modules; and a cutting assembly arranged below the backing support and including one or more knives configured to cut the selected yarns as selected yarns are carried into the backing with the reciprocation of the needles into and out of the backing.

In embodiments, the tufting machine further comprises a control system configured to control operation of the yarn feed system for feeding the selected yarns to the needles, and operation of the jerkers; wherein the control system includes programing configured to dynamically advance operation of the yarn feed system and the jerkers ahead of a next stitch placement step of a pattern being formed.

In some embodiments, the control system further includes programming configured to feed the selected yarns and selectively move the jerkers between their extended and retracted positions based on rotation of a main drive shaft of the tufting machine.

In embodiments, the jerker modules comprise double acting cylinders, having a series of multi-way valves in communication with the bores and configured for controlling flows of air into and through the bores to cause movement of the pistons therealong for controlling extension and retraction of the jerkers.

In embodiments, the bores of the jerker modules have a diameter of less than ½ inch. In some embodiments, the jerker modules comprise double acting cylinders having a reduced profile; and are mounted in one or more groups having a spacing of 8 jerker modules located in about 2 inches.

In embodiments, the proximal ends of each of the jerkers include an anti-rotation mechanism configured to resist rotation of the jerkers as the jerkers are moved between their extended and retracted positions.

In embodiments, the funnels each include an upper end defining and inlet portion, and a lower end defining an outlet in communication with an associated one of the needles; and wherein the inlet portion comprises a multi-angle orifice including a first portion through having a first diameter, and a second portion having a second diameter that is different from the first diameter.

In embodiments, the cutting assembly further comprises a plurality of knife modules within which the knives are received, and actuators each coupled to the one or more of the knife modules and in communication with the knives, the actuators being selectively actuatable to control movement of each of the knives between a retracted position and a cutting position.

In embodiments, the tufting machine further comprises a shift mechanism connected to the backing support and configured to move the backing support transversely with respect to a path of travel of the backing. In some embodiments, the shift mechanism can comprise a rack and pinion shift mechanism.

In embodiments, the yarn feed system comprises at least one yarn feed mechanism having a plurality of yarn feed devices each configured to control feeding of at least one yarn to the needles.

According to other aspects, a tufting machine in provided, comprising: a main drive shaft; a backing support along which a backing is supported; a plurality of needles positioned above the backing support and configured to penetrate the backing to deliver a plurality of selected yarns upon reciprocation of the needles; wherein the needles comprise hollow needles, each having an upper end and a lower end, with a passage defined between the upper and lower ends; a yarn feed system for supplying a plurality of yarns; a series of funnels in communication with the needles; a series of jerkers arranged along a path of travel of the yarns from the yarn feed system to the funnels, each of the jerkers configured to be selectively operated to retract non-selected yarns from the needles; a cutting assembly arranged below the backing support and including one or more knife modules, each comprising a knife configured to cut the selected yarns as selected yarns are carried into the backing with the reciprocation of the needles into and out of the backing; and a control system configured to control feeding of the selected yarns to the needles, and movement of selected jerkers between their extended and retracted positions, the control system including programming configured to advance the feeding of the selected yarns by the yarn feed system and the movement of the selected jerkers ahead of a next tuft placement step of a pattern being formed based on rotation of the main drive shaft of the tufting machine.

In embodiments, the control system further can include programming configured to control feeding of different lengths of the selected yarns during a rotation of the main drive shaft.

In embodiments, the jerkers each comprise a body having a proximal end and a distal end projecting configured to engage and selectively pull back the non-selected yarns as the jerkers are moved from an extended position to a retracted position.

In embodiments, the tufting machine further comprises a plurality of jerker modules, each of the jerkers modules comprising a body having a plurality of bores defined therethrough and coupled to an air supply, a series of pistons received within the bores and coupled to the jerkers, and valves in communication with the bores and configured to control flows of pressurized air into and through the bores to cause movement of the pistons along their bores to control movement of the jerkers between their extended and retracted positions.

In some embodiments, the jerker modules comprise double acting cylinders having a reduced profile; and are mounted in one or more groups of about 8 jerker modules located within a spacing of about 2 inches.

In embodiments, the tufting machine further comprises an air supply in communication with the jerker modules and the cutting assembly; and wherein the control system further comprises programming configured to control flows of pressurized air from the air supply to one or more of the jerker modules for selectively extending and retracting one or more of the jerkers of the jerker modules and/or to one of the knife modules of the cutting assembly for selectively moving one or more of knives of the knife modules between a non-engaging position and one or more cutting positions.

In embodiments, the tufting machine further can comprise one or more regulators positioned between the air supply and the jerker modules and/or the knife modules; wherein the regulators include programming configured to control the flows of pressurized air to the jerker modules and/or the knife modules in accordance with a pattern being tufted.

In some embodiments of the tufting machine, the funnels each include an upper end defining and inlet portion, and a lower end defining an outlet in communication with an associated one of the needles; and wherein the inlet portion comprises a multi-angle orifice including a first portion through having a first diameter, and a second portion having a second diameter that is different from the first diameter.

In embodiments, each of the knife modules of the cutting assembly further comprises an actuator in communication with the knife thereof; and wherein each actuator of each knife module is selectively actuatable to control movement of the knives between a retracted position and a cutting position.

In embodiments, the tufting machine further comprises a shift mechanism configured to move at least one of the backing support and the needles transversely with respect to a path of travel of the backing.

In some embodiments, the yarn feed system comprises at least one yarn feed attachment having a plurality of yarn feed devices each configured to control feeding of at least one yarn to the needles.

In addition, in some embodiments of the tufting machine, each of the funnels can comprise an upper end and a lower end, the lower end defining an outlet in communication with an associated one of the needles; and wherein the upper end includes having a plurality of yarn flow grooves configured to guide one or more yarns into the funnel for feeding to an associated needle.

According to further aspects of the present disclosure, a method of forming patterned tufted articles is provide, comprising: feeding a backing along a path of travel; feeding a plurality of yarns through a yarn selection system and to a plurality of hollow needles; wherein the needle selection system comprises a series of jerker modules in communication with an air supply and including a plurality of bores with pistons received therein, and a plurality of jerkers coupled to the pistons and each comprising a body having a proximal end and a distal end; selecting one or more yarns of the plurality of yarns being fed to the hollow needles and feeding a selected length of the one or more desired color or type yarns to the hollow needles; and controlling feeding of non-selected yarns and moving one or more of the jerkers from an extended position to a retracted position to retract or hold back non-selected yarns from being fed to the hollow needles; and reciprocating the hollow needles into and out of the backing to place tufts of the one or more yarns into the backing in accordance with a pattern being formed.

In embodiments, the method further comprises shifting the backing transversely to its path of travel.

In embodiments, the method further comprises advancing the feeding of the selected yarns by the yarn feed system and the movement of the jerkers between their extended and retracted positions ahead of a next stitch placement step of a pattern being formed based on rotation of the main drive shaft of the tufting machine.

In embodiments, the method further comprises cutting the one or more yarns carried into the backing with the hollow needles to form the tufts.

According to other aspects of the disclosure, a tufting machine comprises: a plurality of hollow needles; a yarn feed mechanism configured to control feeding selected yarns of a plurality of yarns supplied to the hollow needles in accordance with a pattern; an air supply for supplying pressurized air; a yarn selection system configured to retract or hold non-selected yarns from being fed to the hollow needles, the yarn selection system comprising: a series of injectors configured to inject the selected yarns to the needles the hollow needles; a series of jerker modules arranged along a path of travel of the yarns from the yarn feed system to the funnels, each of the jerker modules in communication with the air supply and including a plurality of bores with pistons received therein; and a plurality of jerkers coupled to the pistons and each comprising a body having a proximal end and a distal end configured to engage at least one of the yarns supplied by the yarn feed system; wherein the jerkers are individually moveable between an extended position and a retracted position to retract or hold the non-selected yarns from being fed into the hollow needles by selective control of pressurized air to the bores of the jerker modules in accordance with a pattern being formed.

In embodiments, tufting machine further comprises a cutting assembly arranged below the backing support and including one or more knives configured to cut the selected yarns as selected yarns are carried into the backing with the reciprocation of the needles into and out of the backing.

In embodiments, tufting machine further comprises a control system configured to control operation of the yarn feed system for feeding the selected yarns to the needles, and operation of the jerkers; wherein the control system includes programing configured to dynamically advance operation of the yarn feed system and the jerkers ahead of a next stitch placement step of a pattern being formed.

In some embodiments of the tufting machine, the control system can further include programming configured to feed the selected yarns and selectively move the jerkers between their extended and retracted positions based on rotation of a main drive shaft of the tufting machine.

In some embodiments of the tufting machine, the jerker modules comprise double acting cylinders having a reduced profile; and are mounted in one or more groups having a spacing of 8 jerker modules located in about 2 inches.

In some embodiments of the tufting machine, the proximal ends of each of the jerkers can include an anti-rotation mechanism configured to resist rotation of the jerkers as the jerkers are moved between their extended and retracted positions.

In embodiments, the tufting machine can further comprise a plurality of funnels arranged between the yarn selection system and the hollow needles; wherein the funnels each include an upper end defining and inlet portion, and a lower end defining an outlet in communication with an associated one of the needles; and wherein the inlet portion comprises a multi-angle orifice including a first portion through having a first diameter, and a second portion having a second diameter that is different from the first diameter.

In embodiments, the tufting machine can further comprise one or more regulators positioned between the air supply and the jerker modules; wherein the regulators include programming configured to control the flows of pressurized air to the jerker modules in accordance with the pattern being tufted.

In embodiments, the tufting machine can further comprise a backing support over which a backing is moved for insertion of tufts of yarns by the hollow needles; and rack and pinion shift mechanism connected to the backing support and configured to move the backing support transversely with respect to a path of travel of the backing.

Accordingly, embodiments of hollow needle tufting machines or systems and methods for tufting articles utilizing such hollow needle tufting machines that are directed to the above discussed and other needs are disclosed. The foregoing and other advantages and aspects of the embodiments of the present disclosure will become apparent and more readily appreciated from the following detailed description, taken in conjunction with the accompanying drawings. Moreover, it is to be understood that both the foregoing summary of the disclosure and the following detailed description are exemplary and intended to provide further explanation without limiting the scope of the present disclosure.

DESCRIPTION OF THE DRAWING FIGURES

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DESCRIPTION

Figure 1A:
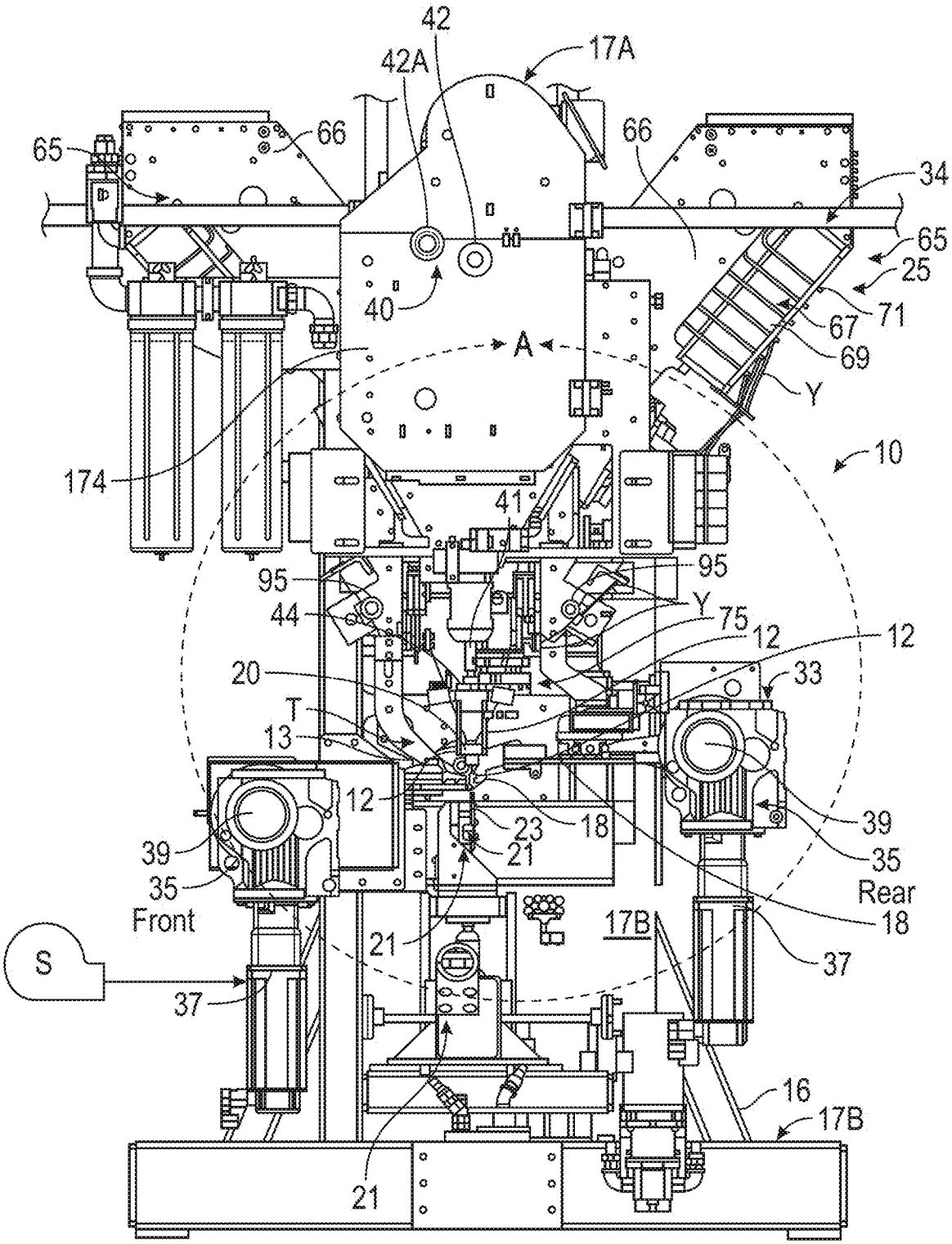
FIG. 1A is an end view of an embodiment of a tufting system or apparatus according to the principles of the present disclosure.
Figure 1B:
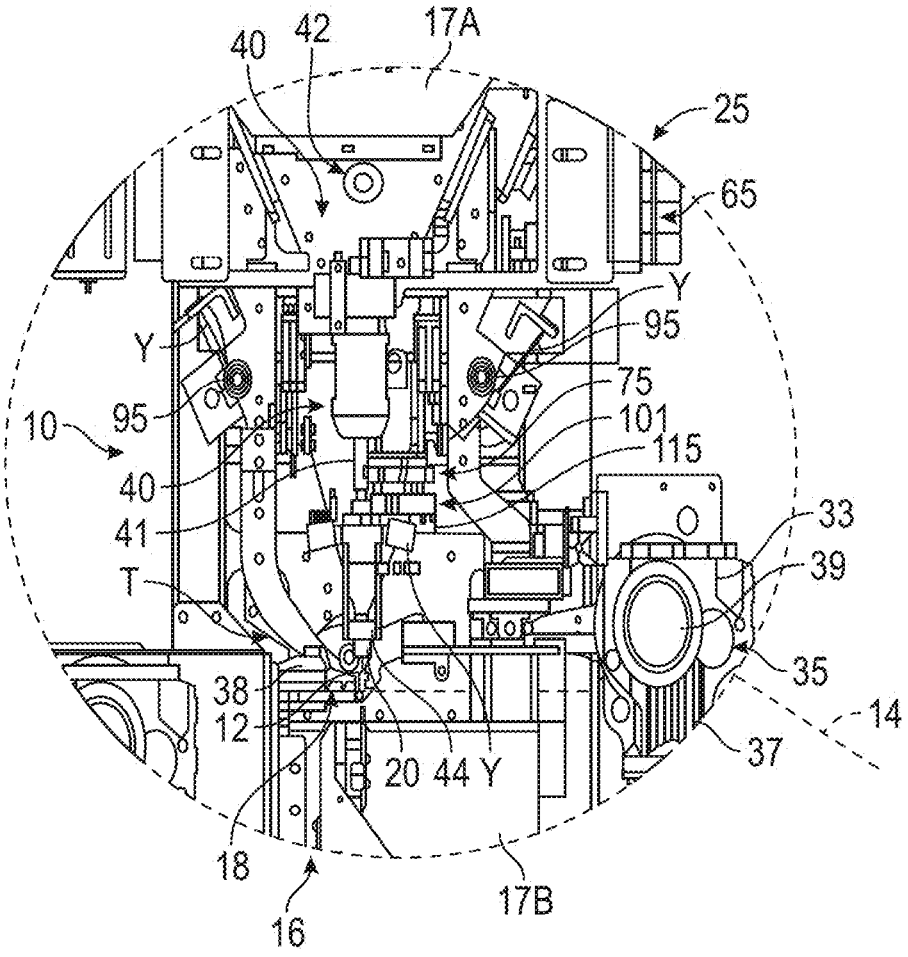
FIG. 1B is a close-up detail view of the tufting zone of the tufting system or apparatus of FIG. 1A.

The present disclosure can be understood more readily by reference to the following detailed description, examples, drawings, and claims, and their previous and following description. However, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting. Accordingly, the following description is provided as illustrative of the principles of the present disclosure and not in limitation thereof.

By way of example, and used throughout, the singular forms "a" and "an" and "the" include plural referents unless the context clearly dictates otherwise. Thus, for example, reference to "a processor" can include two or more such processors unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect.

The term "tuft," as used herein, encompasses both cut pile tufts or stitches and loop pile tufts stitches of yarns, and the term "tufting" encompasses both the act of forming a cut yarn stitch and the act of forming a loop yarn stitch.

Referring to the drawings, in which like numerals indicate like parts through our the several views, FIGS. 1A-12B illustrate exemplary embodiments of a tufting system or apparatus, and various operative components and/or features thereof constructed in accordance with the principles of the present disclosure. In embodiments, such as shown in FIGS. 1A-5, the tufting system or apparatus comprises a hollow needle tufting machine 10 that generally will include a plurality of needles, which, in embodiments, can comprise hollow needles 12 configured for penetrating a backing material 14 to deliver and/or implant a series of yarns Y into the backing as the backing moves along a path of travel P (FIG. 2A) through the hollow needle tufting machine 10 for forming a plurality of tufts of yarns therein.

In embodiments, the hollow needle tufting machine 10 can feed a series of different color and/or type yarns to each of the hollow needles, which yarns can then be selectively implanted or tufted into the backing materials to form tufted patterned articles.

As shown in FIGS. 1A-2B, in embodiments, the hollow needle tufting machine 10 includes frame 16 having an upper portion 17A and a lower portion 17B, a tufting zone or region T defined therethrough, and backing support or shuttle 18 over which the backing is moved, which can be located along the tufting zone. A row of hollow needles 12 can be mounted along a needle bar 20 that is driven in a reciprocating (up and down) motion to cause the needles 12 to penetrate into and out of the backing 14 for implanting tufts of yarns in the backing as the backing moves through the tufting zone or region.

In addition, in embodiments, a yarn cutting or knife system 21 can be provided below the backing support or shuttle 18. In embodiments, the yarn cutting or knife system 21 can include a series of knife modules 22 each including a knife 23. In some embodiments, one or more of the knives 23 can be individually controlled so as to be moved between a no-cut or non-engaging position and one or more cutting positions for selectively cutting the yarns as the yarns are implanted into the backing. The hollow needle tufting machine 10 further generally can include a yarn feed system 25 for supplying lengths of yarn from a yarn supply, such as a creel or beam (not shown) to the needles.

Still further, in embodiments, the hollow needle tufting machine will include a control system 30, which, in embodiments, can include a controller 31 having one or more processors and programming for controlling the operation of the hollow needle tufting machine 10 and the various operative systems and/or operative components of the hollow needle tufting machine so as to produce a patterned tufted article in accordance with a selected pattern. The control system further can be configured to control the supply of pressurized air from an air supply S (e.g., a blower such as indicated in FIG. 1A, or other source of pressurized air) to various ones of the operative systems or components of the hollow needle tufting machine. In embodiments, for example, such as shown in FIG. 3B, the supply of pressurized air can also include or be in communication with a distribution device 26, such as a manifold, which can be divided into banks or sections 26A, 26B, etc . . . , that can be configured to supply different groups or sections of various operative components of the hollow needle tufting machine such as, without limitation, a section of jerker modules and injectors of the yarn selection system 75, the knife modules 22 of the cutting assembly 21, and/or other components.

In embodiments, the length of the hollow needle tufting machine, the spacing of the needles, and the number of needles can vary depending on the product to be produced and the desired rate of production. For example, in embodiments, the hollow needle tufting machine can be configured to produce carpets, turf, rugs, or other articles of a selected size or a range of sizes.

In embodiments, the backing material 14 may be advanced longitudinally past the reciprocating needles by a backing feed system 35, which, in embodiments, can comprise feed rollers 36, which further can comprise spike rolls, and which can be driven by motors 37 (e.g., servo or stepper motors, or other drives). The backing feed system 35 generally will be controlled (e.g., by the control system 30), and can, in embodiments, be provided with a backing feed controller programmed and configured as to feed the backing 14 (FIG. 2A) under tension beneath the needles 12 and through the tufting zone T of the hollow needle tufting machine 10.

The backing feed system can be controlled to move the backing 14 in a controlled movement, e.g., in embodiments, in a stepping motion, and the backing further can be shifted. As the needles are reciprocated into and out of the backing, a series of yarns Y are inserted into the backing by the needles to form tufts of yarns. In embodiments, the tufts of yarns can comprise loop pile tufts, cut pile tufts or combinations thereof. In some embodiments, the tufts can be formed with different or varying pile heights, to provide texturing or other effects. The various color and/or type yarns can be selectively provided to each of the needles for forming tufted articles such as carpets, rugs, artificial turf or grass, and other tufted fabrics. In embodiments, such tufted articles can be formed with selected designs, which can include, without limitation, yarns of different colors or types, texturing, and/or other pattern effects.

The hollow needle tufting machine 10 can include a needle bar drive system 40 configured and operable to reciprocate the needle bar, carrying the needles 12 into and out of the backing 14. In embodiments, the needle bar drive system can include push rods 41 (FIGS. 4-5) coupled to the needle bar at lower ends thereof, and to a main shaft 42 (FIGS. 1A and 2B) of the hollow needle tufting machine 10. For example, upper ends of the push rods can be connected to cam members carried on and driven by the main shaft. In embodiments, the main shaft can be located offset from the center of each cam member and can be supported by bearings. Each push rod can extend through guides or bearings to help guide the vertical reciprocating motion thereof.

Figure 2A:
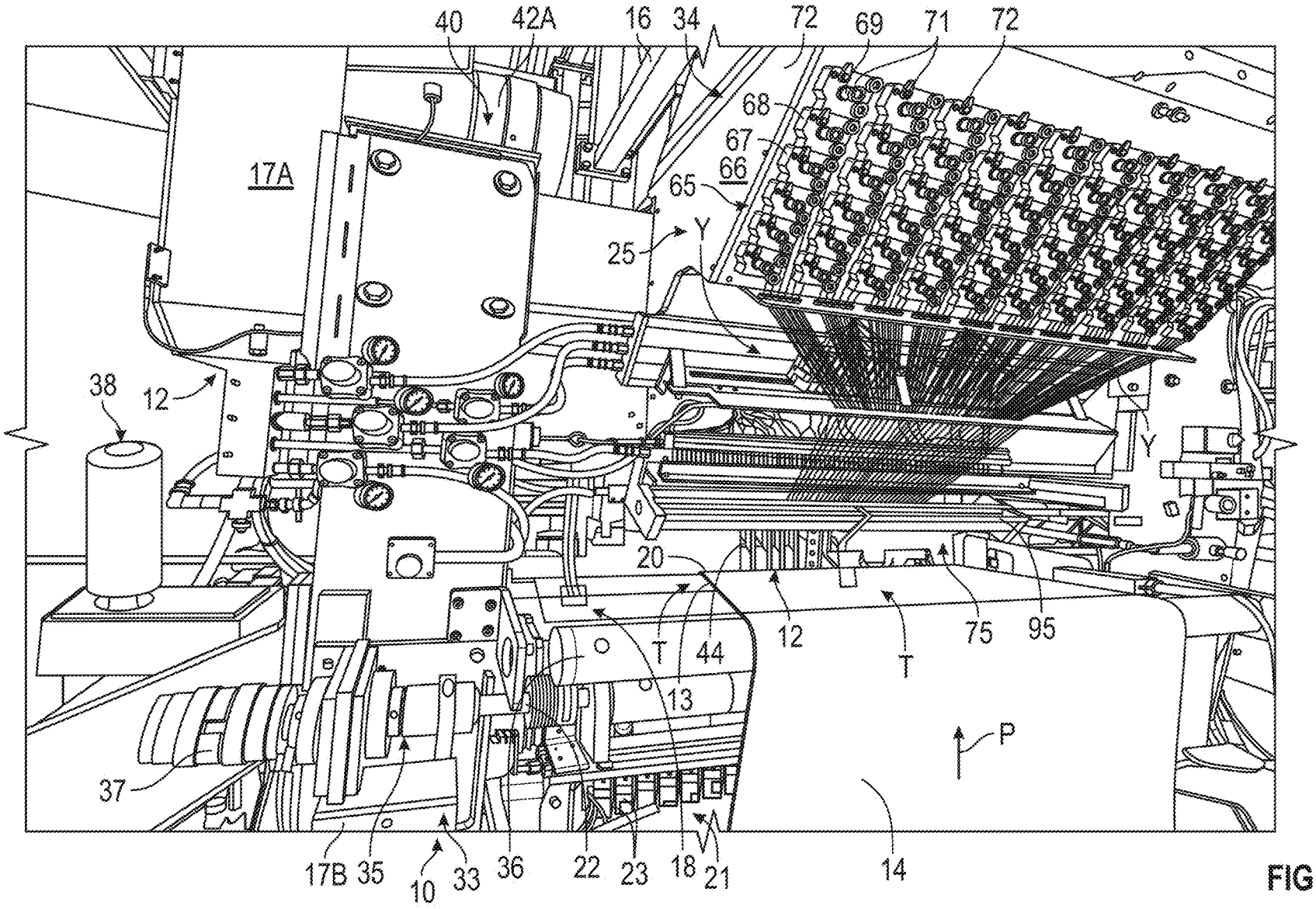
FIGS. 2A-2B are perspective views of an embodiment of the tufting system or apparatus of FIGS. 1A-1B.
Figure 2B:
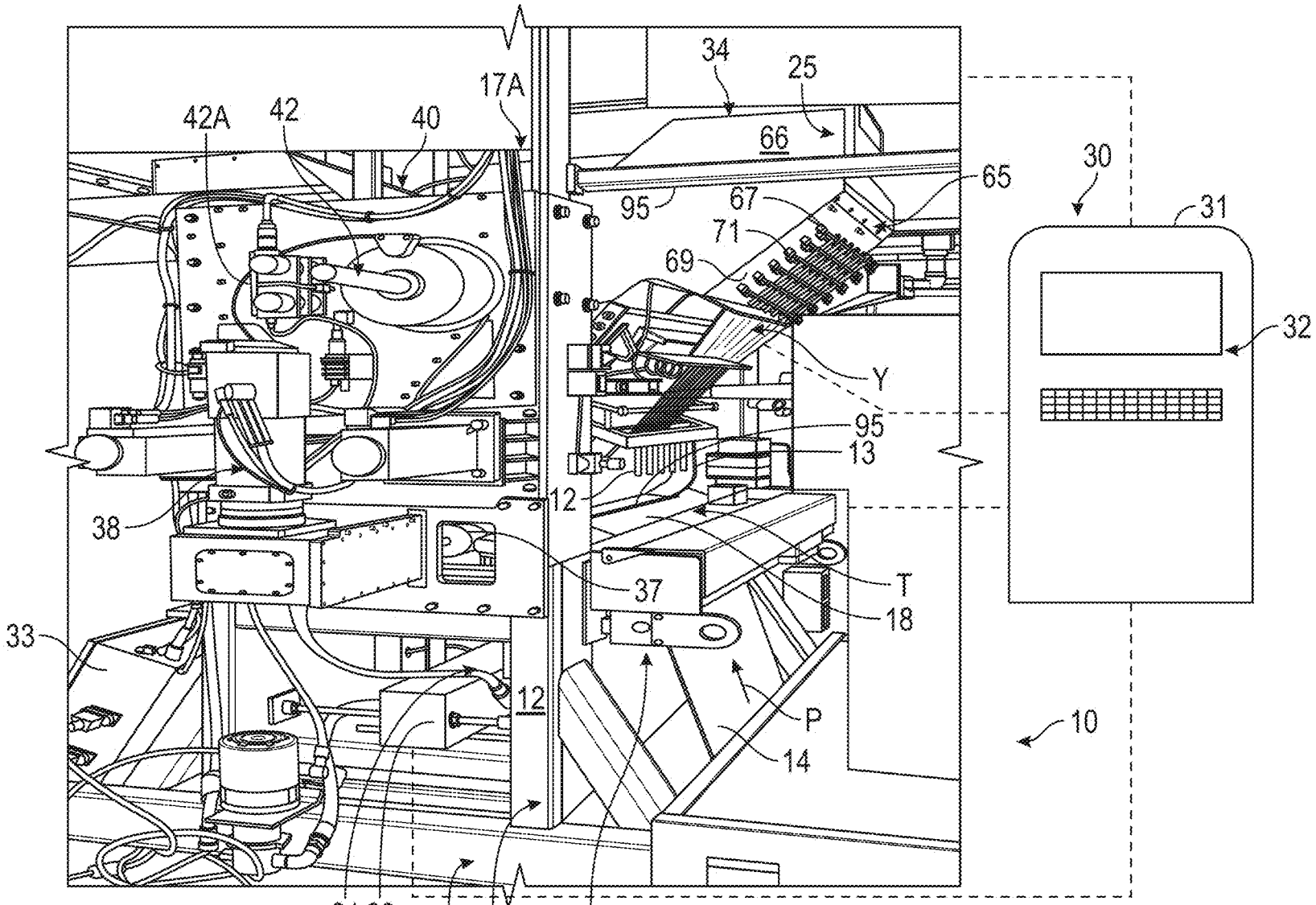

As illustrated in FIGS. 1A and 2A-2B, the main drive shaft 42, and, in some embodiments, the needle bar drive system 40, can be driven by one or more electric motors 42A operatively connected to opposite ends of the main drive shaft and mounted to opposite ends of the frame of the hollow needle tufting machine for rotating the main drive shaft. The one or more motors, with drive rotation of the main shaft at operating speeds, are configured to operate under control of the control system. For example, in embodiments, the motors 42A can rotate the main drive shaft at speeds up to about 1000 rpm or greater for high product throughput.

In operation, each rotation of the main drive shaft can cause the needles to penetrate and then withdraw from the backing. In other words, each rotation of the main drive shaft can cause one needle reciprocation cycle, also referred to as a tufting cycle, which includes a downstroke and an upstroke of the needles. In embodiments, the control of various operational systems or components further can be tied to the rotation or position of the main shaft.

Figure 4:
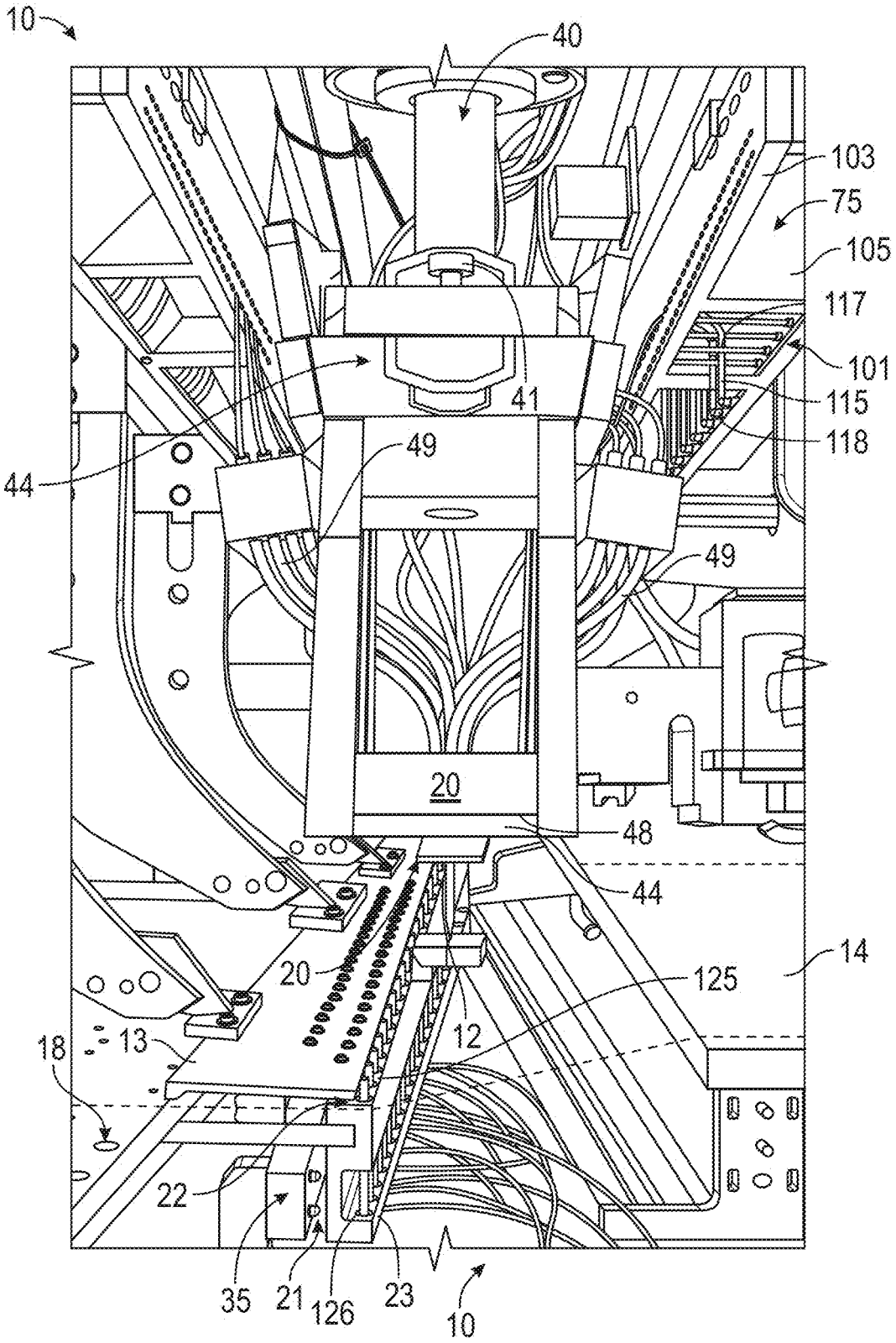
FIG. 4 is an end view of an embodiment of a needle bar with yarn feed tubes for feeding yarns from yarn jerkers to the needles of a tufting system or apparatus according to the principles of the present disclosure.

As indicated in FIG. 4, the lower ends of the push rods further can be connected to a needle bar mounting plate 44 that is connected to and supports the transversely extending needle bar 20. The needles 12 can be mounted to the needle bar 20, arranged in spaced series along the needle bar, or at least a portion thereof. For example, each of the needles can be located at a selected or desired spacing from adjacent needles, e.g., in embodiments, being located at a 1" gauge spacing across the width of the tufting machine. Other needle spacing distances also can be used. Upon rotation of the main shaft, the reciprocating movement of the main shaft is imparted to the push rods, which correspondingly drives the needle bar in a similar reciprocating (up and down) movement to cause the needles 12 to repetitively penetrate into and withdraw from the backing 14 introduce yarns into the backing for forming a plurality of tufts in the backing.

Figure 3A:
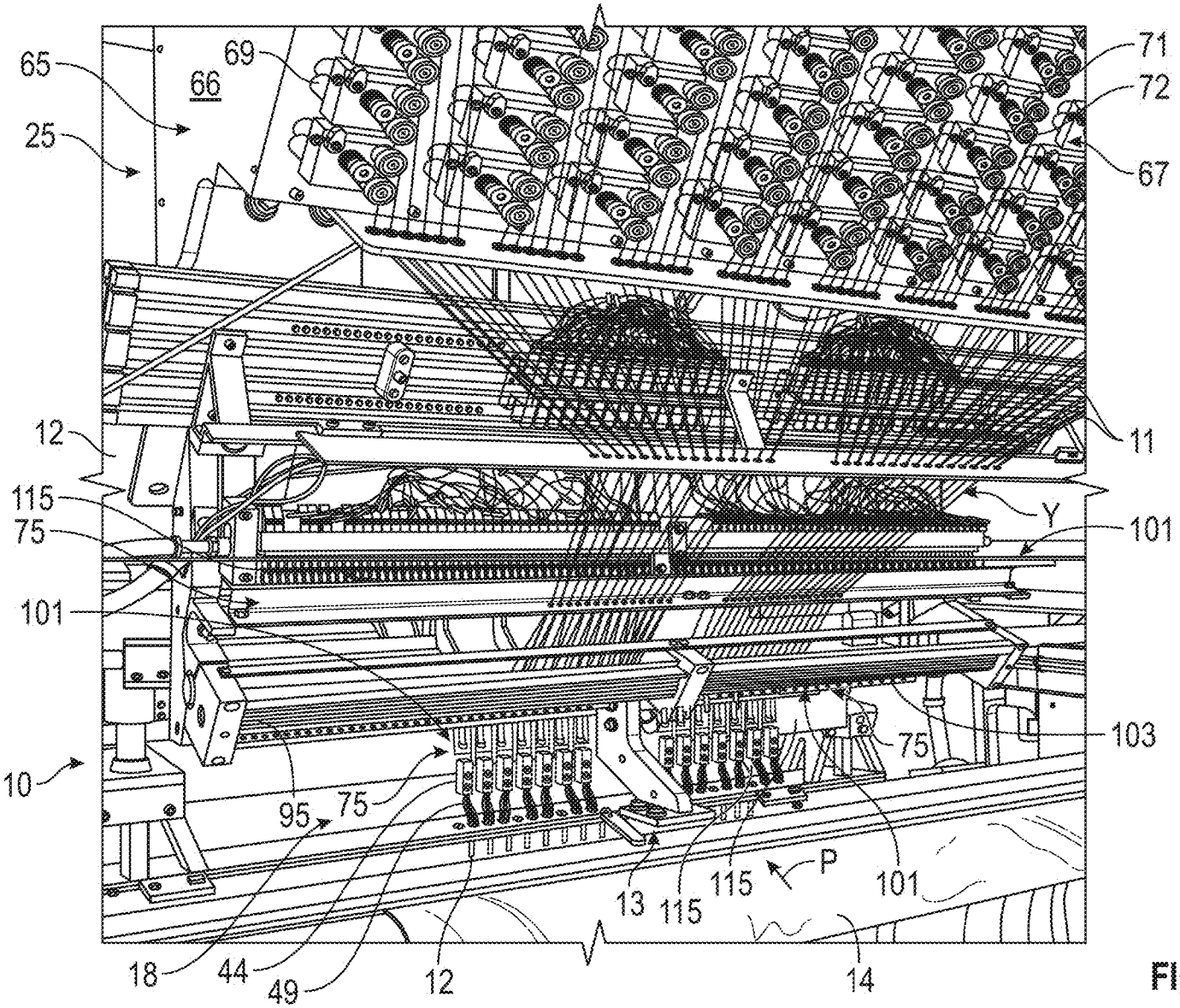
FIGS. 3A-3B are front perspective views of a portion of the tufting system or apparatus such as illustrated in FIGS. 1A-2B, showing yarns being fed through puller rolls and to the needles according to the principles of the present disclosure.
Figure 3B:
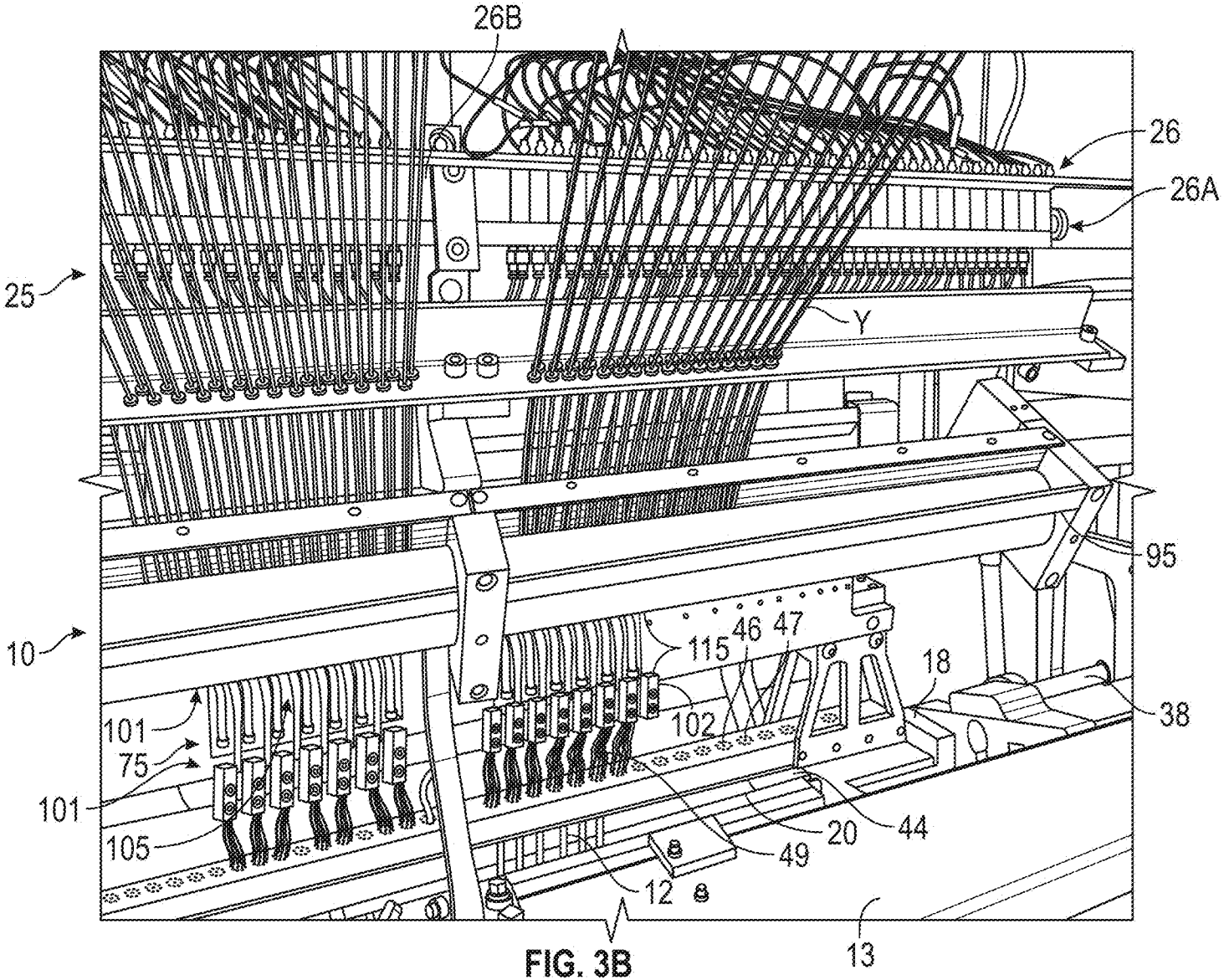
Figure 5:
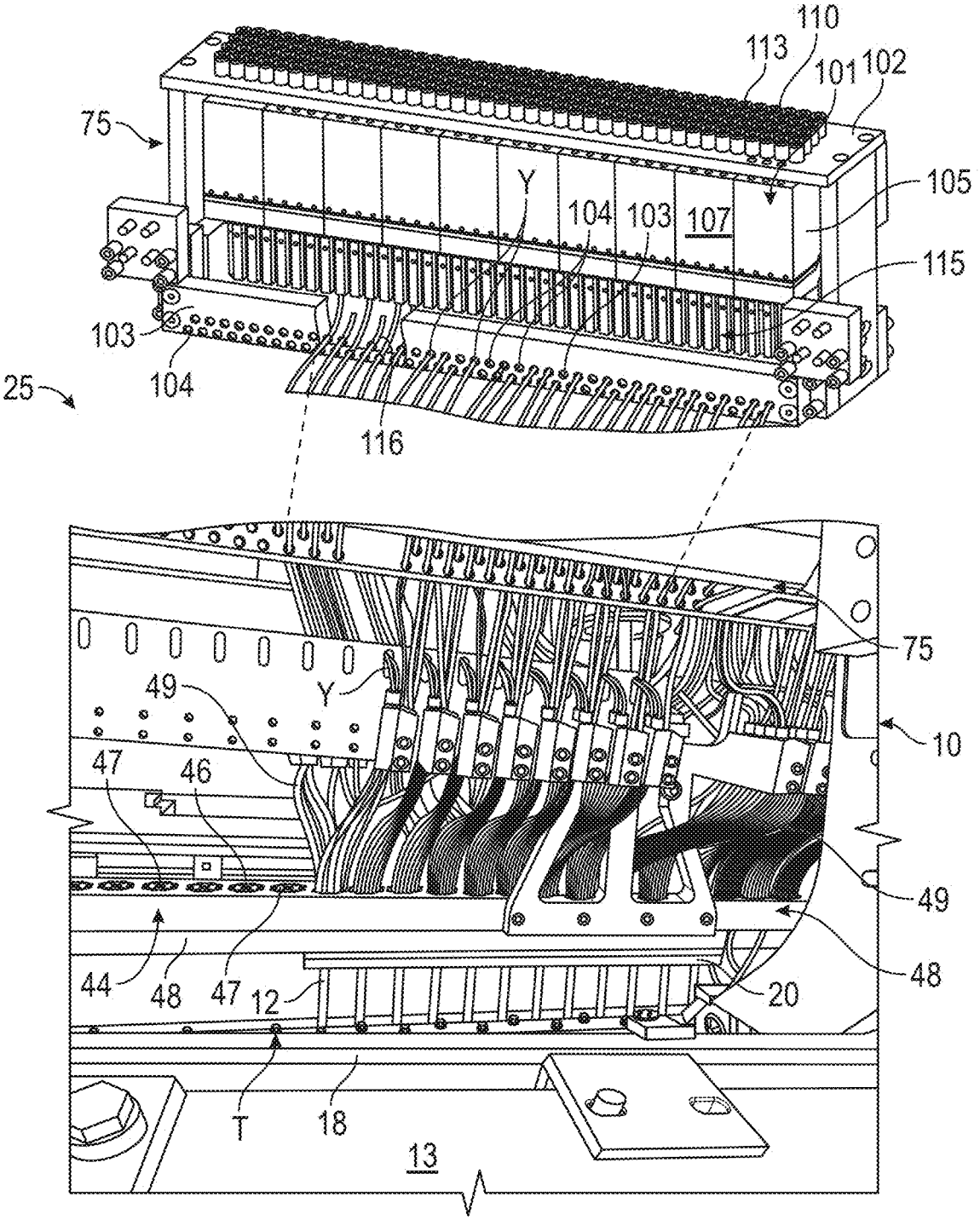
FIG. 5 is a side elevational view of an embodiment of a yarn selection system for a tufting system or apparatus according to the principles of the present disclosure.
Figure 6A:
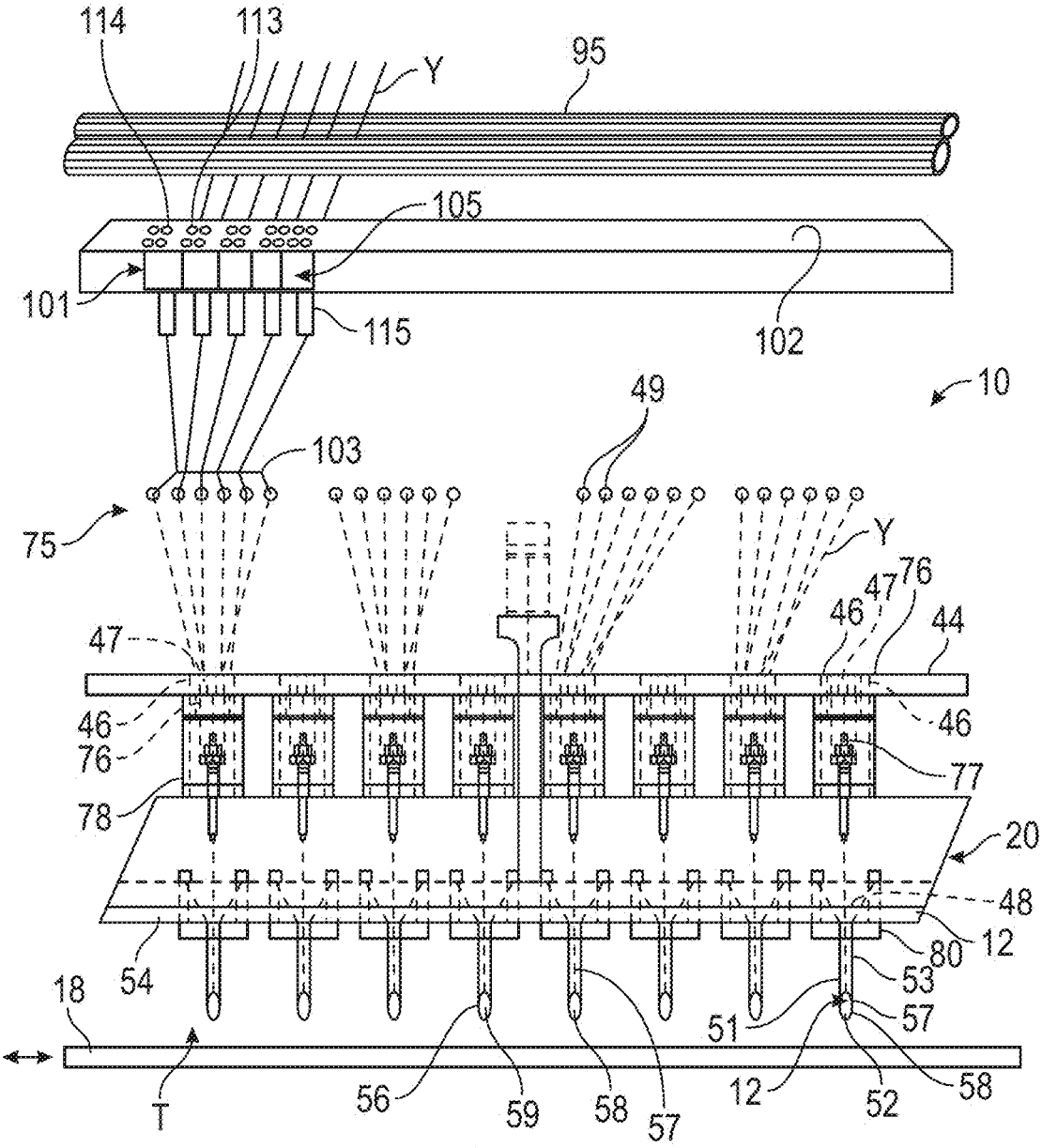
FIG. 6A is a side elevational view schematically illustrating yarns being fed to the injectors and through feed tubes to a needle bar mounting plate for feeding a series of yarns to through funnel block and to a series of needles arranged along a needle bar of a tufting system or apparatus according to the principles of the present disclosure.

In embodiments, the needle bar mounting plate 44 can be rectangular in cross-section, and for each needle, one or more passages 46 can be provided that extend from inlets 47 at the top of the needle bar mounting plate 44 to a funnel block 48, which is connected to each needle 12 as indicated in FIGS. 3A-3B and 6A. A plurality of yarn conduits 49 (FIGS. 4-5) can be coupled to each of the respective inlets 47 in the top of the needle bar mounting plate, for supplying a plurality of yarns to the inlets and to their respective needles 12. Each funnel block 48 generally can include a funnel that extends from an inlet to an outlet at the bottom of the needle bar mounting plate and that is configured to receive and direct yarns fed from the yarn feed system. As illustrated, the funnel blocks are configured to receive and direct each of the yarns fed from the yarn head system to the needles therebelow.

As illustrated in FIGS. 1B, 6A and 11A-11B, each of the needles 12 generally can have an elongated hollow body 51 defining a central passage 52 through which yarns are fed as indicated in FIG. 5, and having a first, inlet or distal end 53 that can be received within a module or mounting block 54, which, in embodiments, can include an elongated body 54A configured to attach to the needle bar 20. Alternatively, in some embodiments, the needles can be separately attached to the needle bar, mounted in spaced series therealong. The needles further will include an open, second or distal end 56 that terminates at a pointed tip 57. It is further illustrated in FIGS. 11A-11B, that, in embodiments, the proximal end of each of the needles further generally can include a cutting edge or surface 58, which can comprise an angled surface that extends upwardly from the tip 57 to an intermediate point along the body of each needle, and in some embodiments, can further include a recess at an upper end thereof, which recess can be configured to help hold or capture a yarn during cutting.

Figure 11A:
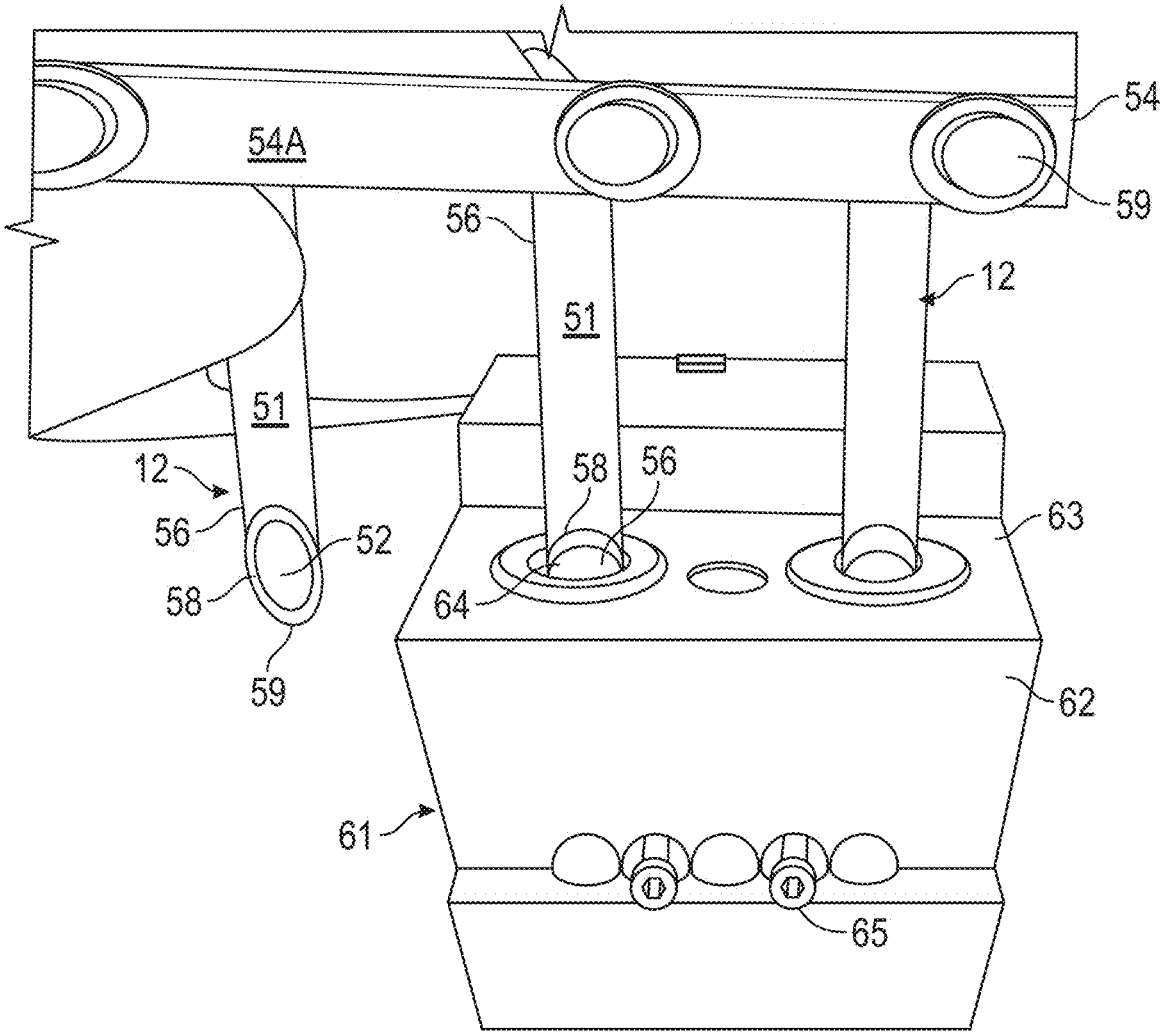
FIGS. 11A-11B illustrate embodiments of hollow needles and a locating assembly for aligning the hollow needles for mounting along a needle bar of a tufting system or apparatus according to principles of the disclosure.
Figure 11B:
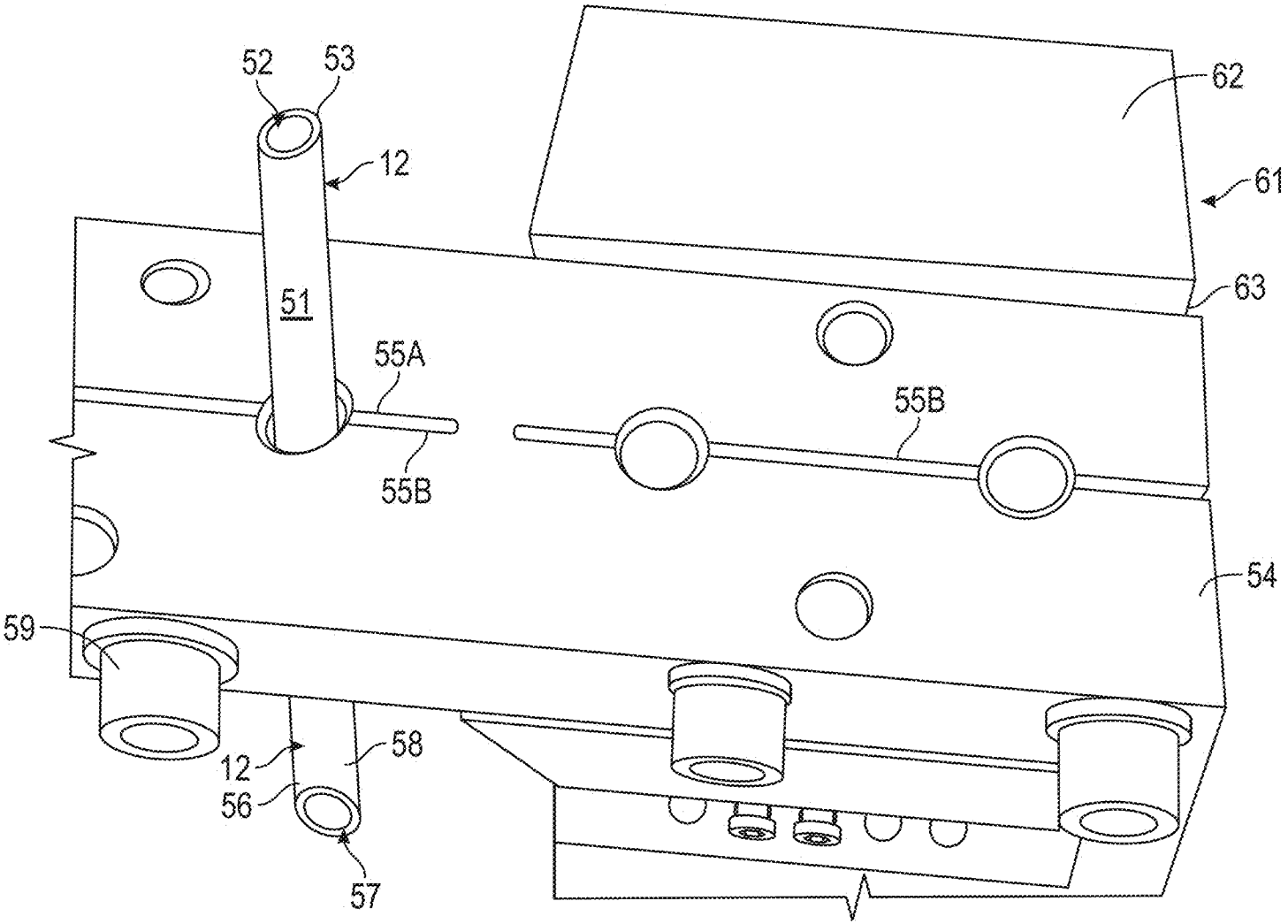

In embodiments, the needles 12 can be mounted in spaced series along their module(s) or mounting block(s) 54, with one or more modules or mounting blocks being mounted to the needle bar. For example, in embodiments, such as shown in FIGS. 11A-11B, a jig 61 can be provided for aligning or orienting each of the needles within their module(s) to generally fix needles in place, with their cutting surfaces, oriented in a proper or selected orientation or arrangement for engagement by the knives 23 of the yarn cutting or knife system 22 therebelow. In embodiments, such as indicated 11A-11B, the jig 61 can comprise a body 62 that can have a stepped profile 63 at an upper end thereof, which profile will be configured to receive a module or mounting block/support bar 54 for the needles thereon, and further can include a series of needle receiving bores 64.

As shown in FIG. 11B, in embodiments, the needles 12 can be inserted though needle mounting openings 55A defined in the module or mounting block 54, which, in some embodiments, can further include one or more longitudinal slots or areas of separation 55A along which the needle mounting openings are spaced, and into the needle receiving bores 64 of the jig; and will be guided, e.g., caused to rotate or otherwise be oriented with their cutting surfaces aligned in a selected position for engagement with the knives of the yarn cutting or knife system. In embodiments, set screws 65 or similar fasteners further can be provided for adjusting the rotation, travel and/or orientation of the cutting surfaces of the needles within the passages of the jig.

Once the needles 12 have been placed into a proper, selected alignment, the needles can be secured along the module or mounting block by engaging fasteners 59, such as set screws or other, similar arranged along a side surface of the module or mounting block, as indicated in FIG. 11B, to secure the needles in place and in a desired alignment for engagement with the knives 23 of the yarn cutting or knife system 22, and without generally requiring additional movement or rotation of the needles and/or knives during operation the hollow needle tufting machine. For example, in embodiments, as the fasteners 59 are engaged against the side surface of the module or mounting bar 54, the slot(s) 55A can be closed against the bodies of the needles to secure the needles in a desired orientation.

As indicated in FIGS. 1A-6A, the series of different color or types of yarns Y fed to each of the needles in the yarn feed system 25 of the hollow needle tufting machine 10. In embodiments, the yarn feed system of the hollow needle tufting machine can include one or more yarn feed mechanisms or attachments 65 (FIGS. 1A and 2A-2B). In embodiments, such yarn feed mechanisms or attachments 65 can be mounted on opposite sides of the tufting machine. For example, as illustrated in FIGS. 1A and 2B, one or more yarn feed attachments can be located on both sides, e.g., along an upstream side and a downstream side, of the hollow needle tufting machine being mounted to and supported on the frame thereof.

In embodiments, the yarn feed attachments or mechanisms 65 can comprise single end or double end yarn feed mechanisms or attachments, such as an Infinity™ or Infinity IIE™ current feed attachment as produced by Card-Monroe Corp. of Chattanooga, Tennessee. Each of the yarn feed mechanisms or attachments 65 can include a housing 66, in which a plurality of yarn feed devices 67 can be received. As indicated in FIGS. 1A, 2A and 2B, each of the yarn feed devices 68 can include a motor 69 which drives at least one driven yarn feed roll 71, with one or more idler feed rolls 72 being driven by the rotation of the drive roller 71. Each of the yarn feed devices can feed 1-2 (or potentially more) yarns to associated ones of the needles of the hollow needle tufting machine. The yarn feed devices each further can be individually controlled by the control system of the hollow needle tufting machine so as to selectively control the feeding of individual yarn to their needles.

In embodiments and as indicated in FIGS. 2A, 2B and 6A, the yarn feed devices can be configured to feed at least one yarn to the needles, with each of the yarn feed devices feeding at least one different color or type yarn. In embodiments, a series or set of yarn feed devices can selectively feed their yarns to an individual, associated needle. For example, and without limitation, a set of 8 yarn feed devices can be associated with a needle, and each can feed a different color or type yarn to the associated needle through a yarn selection system 75 and through the yarn conduits 49 that extend from the yarn selection system 75 to the inlets 47 of the needle bar mounting plate 44 as indicated in FIG. 5. Different sets or series of yarn feed devices (e.g., sets of 8 or more yarn feed devices) of each of the yarn feed mechanisms or attachments mounted on the opposite sides of the frame of the tufting machine can feed yarns (e.g., 8 or more yarns) to respective ones of the needles. For example, yarn feed devices of the yarn feed mechanism or attachment on the front side of the tufting machine can feed their yarns to every other needle, while the yarn feed devices of the yarn feed mechanisms or attachments mounted along the rear backside of the tufting machine can feed their yarns to intervening ones of the needles.

Figure 6B:
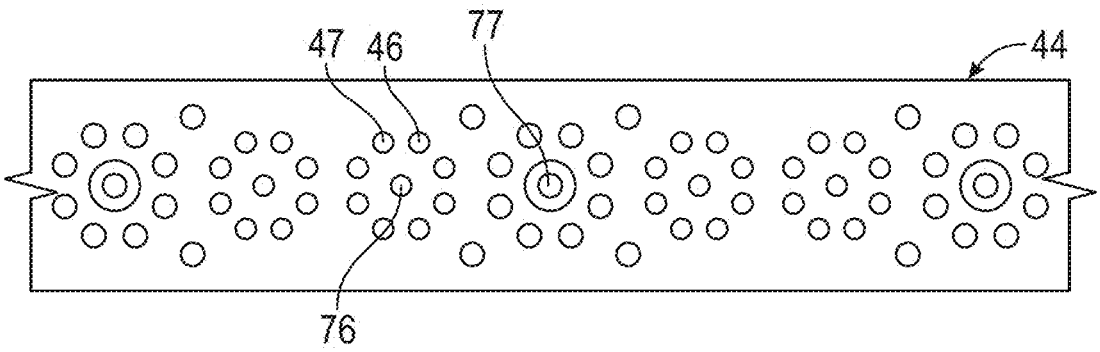
FIG. 6B illustrates an embodiment of a needle bar mounting plate to which yarn feed tubes are coupled and including an injector for feeding yarns to needles of a tufting system or apparatus according to the principles of the present disclosure.

As indicated in FIG. 5, yarns will be fed through the passages 46 defined through the needle bar mounting plate 44 into the funnel blocks 48. Each yarn typically will be fed through an individual yarn conduit 49 that will be coupled to one of inlets 47 associated with each needle. FIG. 6B illustrates an example embodiments of a needle bar mounting plate 44 with sets of inlets arranged therealong. As shown in FIG. 6B, in embodiments, sets of 8 inlets 47 can be provided, with each set generally including an inlet for each color or type of yarn being supplied to the needle associated therewith (e.g., 8 colors of yarns), spaced around a central bore 76 configured to enable insertion of an injector 77 therethrough. In is contemplated that additional or fewer inlets also can be provided. As further indicated in FIG. 6A, in embodiments, each of the passages 46 extends from its inlet 47 through the needle bar mounting plate to an opening at the lower end of the needle bar support plate. In embodiments, the lip or edge can be defined at the lower end of the passages to provide a stop 78 for the insertion of the yarn conduits therethrough to prevent the yarn conduits from extending or being pulled all the way through the needle bar mounting plate.

Figure 7A:
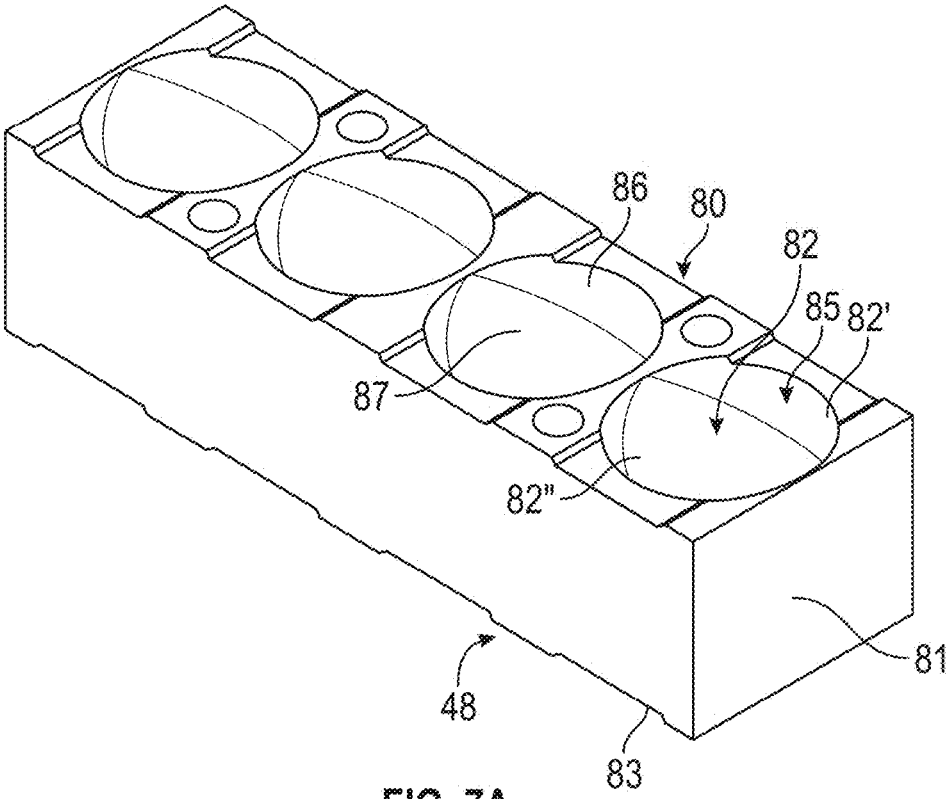
FIGS. 7A-7C illustrate an embodiment of a funnel block for feeding yarns to hollow needles of a tufting system or apparatus according to the principles of the present disclosure.
Figure 7B:
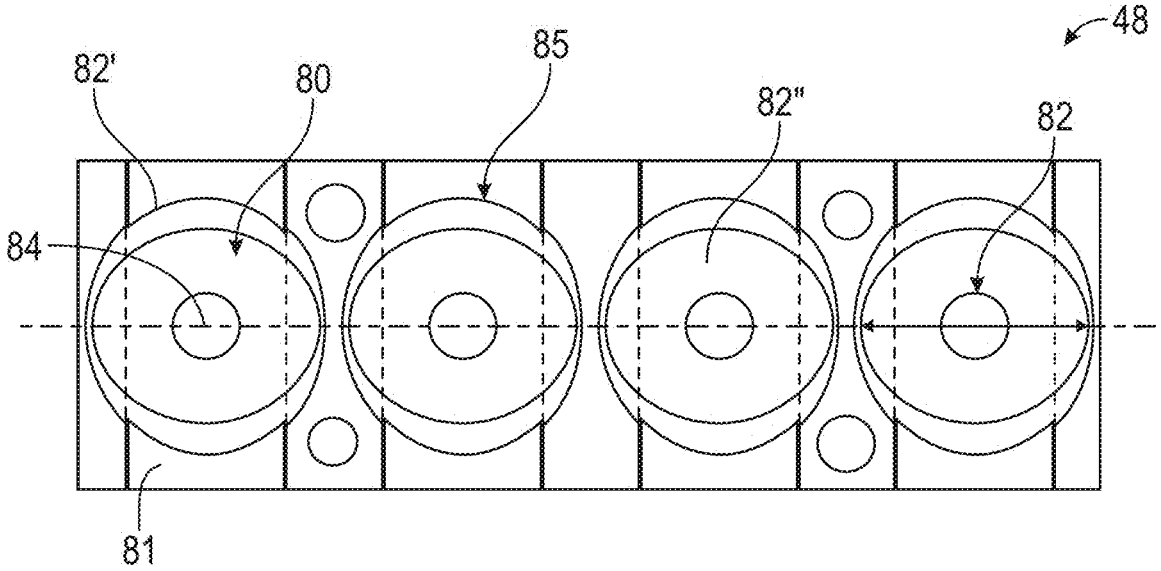
Figure 7C:
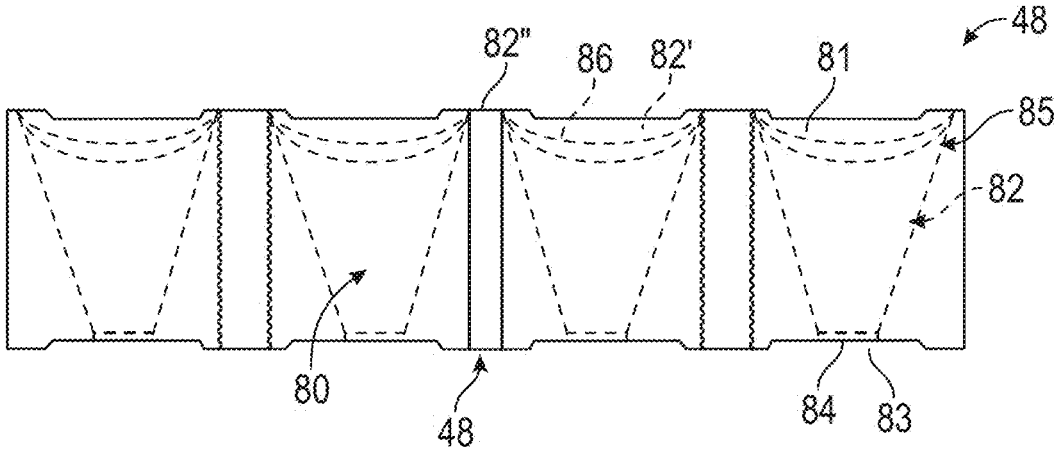
Figure 8A:
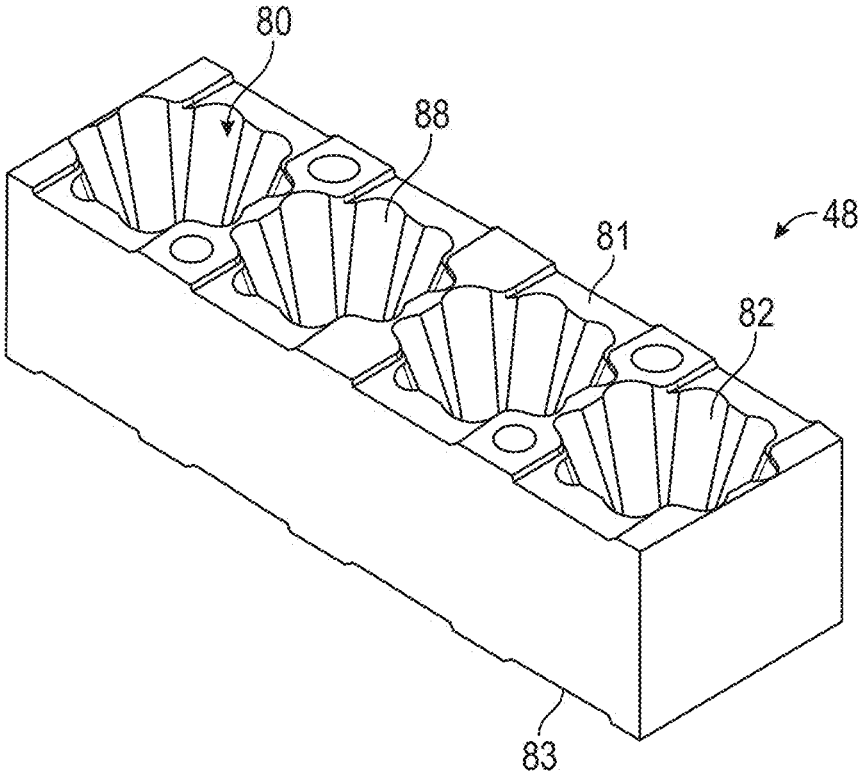
FIGS. 8A-8C illustrate another embodiment of a funnel block for feeding yarns to hollow needles of a tufting system or apparatus according to the principles of the present disclosure.
Figure 8B:
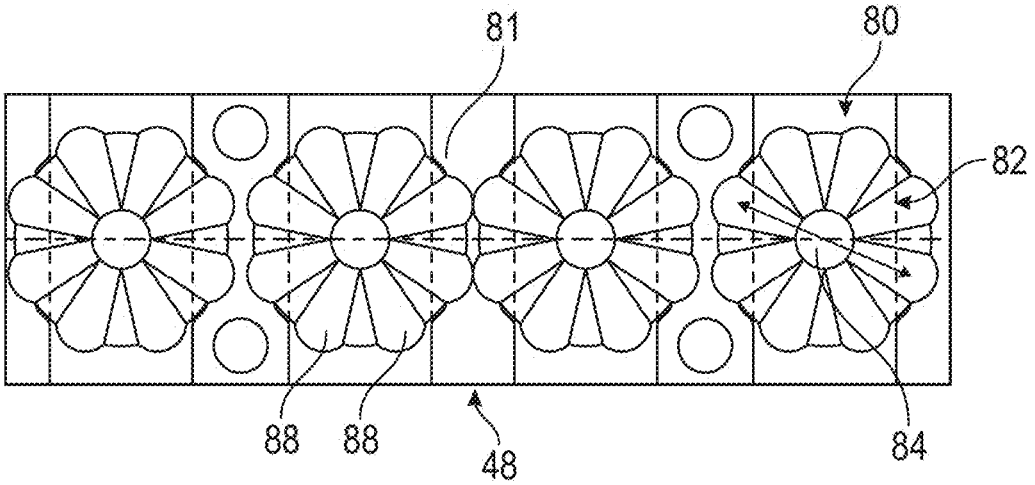
Figure 8C:
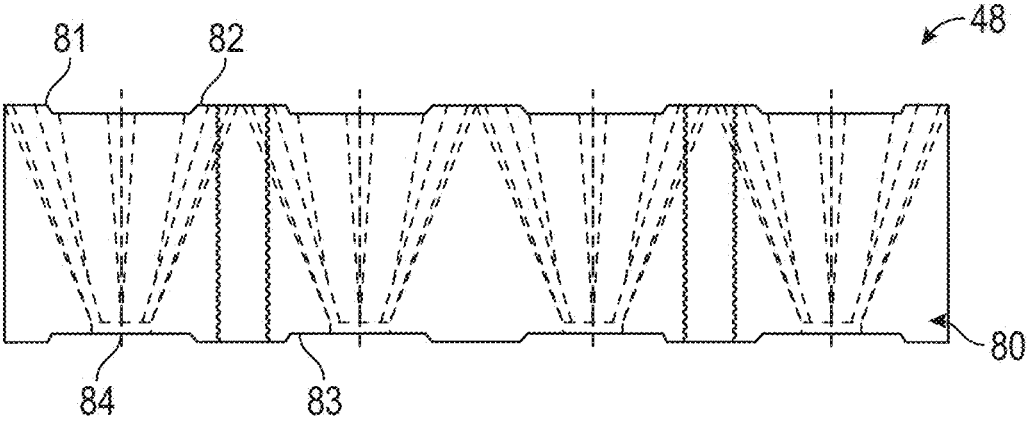

FIGS. 7A-8C illustrate example embodiments of funnel blocks 48 for use with the hollow needle tufting machine 10. The funnel blocks can include a body, typically formed from a hardened material such as a metal (e.g., steel or aluminum) or other, similar durable material, and each will include a series of funnels 80. As indicated in FIGS. 7C and 8C, each of the funnels 80 generally can include a first or upper end 81 and a side wall 82 that tapers down to a second or lower end 83, terminating at an opening 84 along the bottom surface of the funnel block, and to which a needle is coupled. As selected ones of the yarns are fed and injected into each funnel, the selected yarns will be guided to and into the hollow bores of the needles for delivery of the yarns into or implantation into the backing.

In a first embodiment, shown in FIGS. 7A-7C, the funnels can include multi-angle circular orifice 85, having a first, inlet portion at the upper end 81 of the funnel, which first portion has a first diameter and tapers downwardly toward along a first wall section 82' toward a second orifice portion 86 which has a second diameter. The side wall 82" of the second orifice portion 86 extends downwardly, tapering toward the opening 84 at the bottom end of the funnel. In embodiments, the first diameter or the first orifice portion will be greater than the second diameter of the second orifice portion. In embodiments, the taper of the wall 82' of the first orifice portion can have a shallower or flatter angle of taper than an angle of taper of the wall 82" of the second orifice portion. For example, in embodiments, the angle of taper of the wall of the first orifice portion can be approximately 1° to approximately 25°, while the angle of taper of the wall of the second orifice portion can be from approximately 25° to approximately 45°. Other angles are also contemplated. As the yarns are fed into the funnels, the yarns can be guided by the shallower angle first orifice portions toward the second orifice portions that guide the yarns toward the center of the funnels to enable a smoother feeding of the yarns into and through the funnels.

FIGS. 8A-8C illustrate another, alternative embodiment of a funnel block 48. As indicated in FIG. 8A, in this embodiment, the funnels 80 are formed with a fluted design having a plurality of flutes 88 arranged in series about the circumference of the upper open end of the funnel. Each of the flutes can define a yarn receiving groove that slopes downwardly toward the lower orifice of the funnel for guiding individual yarns into an associated hollow needle. FIGS. 8A and 8B illustrate a fluted funnel design with approximately 8 flutes, though it will be understood by those skilled in the art that fewer or greater numbers of flutes also can be used. In addition, in embodiments, it is possible to feed multiple yarns to each flute such that each flute can be used to direct one or more yarns supplied from the yarn feed system to the associated hollow needle.

In addition, in embodiments, an air tube can be connected to the injector 77 for selectively supplying air to the injector for blowing pressurized air to maintain the positions of the plurality of yarns within the needle bar 42 for reasons hereinafter described. Preferably, as illustrated, the lower end of each injector is at the exit of the needle bar 42 and in the inlet of the needles 12. The injector preferably includes a plurality of jets or openings 49. The injector may have a larger diameter than the interior passageway of the needle 12 in order to ensure adequate airflow into the needle 12. Each injector can feed with air from an air supply tube 50 fed with air from the air supply, and which, in embodiments, can also include air manifold 52 through which a supply of pressurized air can be distributed to the injectors.

A plurality of yarns can be disposed within the funnel block for feeding into the needles. During the needle thread-up process, whereby yarns are inserted into the needles, a selected yarn is forced by the air injector into the needle 12. During the tufting process, the yarn being sewn and the other yarns within the needle are held in the needle by air pressure acting on the yarns from the injector 48 and by control of the feeding and supply of the yarns by the yarn feed system and the yarn selection system.

During each tufting cycle, the hollow needles can reciprocate between a raised or top position and a lowered or bottom position. The backing can be positioned between the top position and the bottom position of the tufting cycle penetrating the backing. In one cycle, the tip of each hollow needle can travel from the top position to the bottom position and back to the top position. Between the top position and the bottom position, the hollow needle can penetrate the backing and implant a yard tuft therein. The movement of the hollow needle between the top position and the bottom position is the downstroke of the cycle, and the movement of the needles from the bottom position to the top position is the upstroke of the cycle.

As noted, each of the yarns fed to each of the needles can have a separate yarn feed device that can be operated by the system control (e.g., each yarn feed device or set of yarn feed devices can have its own controller or be linked to a yarn feed system controller that can be configured to control a series of yarn feed devices) so that the length of each yarn fed with the needles for each selected stitch of a pattern can be controlled to enable enhanced precision in feeding of each yarn that is selected to form a corresponding tuft in the backing while the non-selected yarns can be controlled and, in embodiments, can be pulled back (e.g., by operation of the yarn jerkers associated with such non-selected yarns).

In addition, a series of puller rolls 95 can be provided along the upstream and downstream sides of the tufting zone, along the front and rear sides of the hollow needle tufting machine. The rotation of the puller rolls can be controlled by the control system to ensure a substantially consistent feeding of the yarns to the needle. The feeding of each of the yarns by the yarn feed devices can be controlled based upon rotation of the main shaft so as to essentially match a rate of feed of the yarns from the yarn feed devices so as to deliver a desired amount or length of yarn within portions of the revolution of the main shaft to help ensure substantially consistent yarn delivery by the puller rolls.

For example, in embodiments, the yarn feed devices can be controlled by the control system 30 so as to supply a total stitch length of a selected yarn (e.g., a length of yarn required for performing a tuft to base selected or desired length) within a portion of each stitch cycle or revolution of the main shaft of the hollow needle tufting machine. In embodiments, different lengths or amounts of yarn making up a total stitch length of each selected yarn to be fed for forming a tuft of a desired pile height can be fed at an increased or decreased rate during different portions of the tufting cycle, or at different times based on the rotation or position of the main shaft (e.g., in embodiments, the yarn feed devices of the yarn feed system can be operated to feed different percentages or amounts of yarns in view of where the main shaft is in a revolution thereof, as opposed to feeding a substantially consistent amount of yarn during a revolution of the main drive shaft).

In embodiments, the puller rolls can be driven at a rate, and in time with the feed rolls of the yarn feed devices, to generally keep the yarns from wrapping about the feed rolls. In some embodiments, the puller rolls can further be driven at a rate and/or at a combination of a rate and position with respect to the rotation of main drive shaft such that they are primarily feeding in sync with the feeding of the yarns in different amounts or percentages at within different portions of the rotation of the main drive shaft. By way of example only, if a yarn being feed for selected colors of yarns is about 4" during an initial 120° of the rotation of the main drive shaft, the puller rolls could be operated to feed a little more than 4" of the selected yarns during the 120° of the rotation of the main drive shaft. During the remaining 240°, the puller rolls and/or the feed rolls of the yarn feed devices for the selected yarns could be used to slow down and/or speed back up the feeding of such selected yarns to the needles as needed (to help minimize extra pull on the yarn). Still further, in embodiments, the yarn feed rates for forming a first and/or last stitch of a selected color or type of yarn can be adjusted in view of an upcoming tuft row color change in the pattern design being formed.

Such control of the delivery of the yarns by each of the yarn feed devices can provide for delivery of the yarns to the puller rolls provided along the front and rear sides of the tufting machine at a rate selected and controlled to substantially maintain consistency of the feeding of the yarns to the needles. In embodiments, the puller rolls can be operated to rotate at a different rate than the yarn feed rolls. For example, in embodiments, the puller rolls can be driven at a rate that is substantially in sync with the feeding of the yarns and that is sufficient to generally keep the yarns pulled off of the yarn feed rolls to minimize wrapping of the yarns around the yarn feed rolls.

Figure 9A:
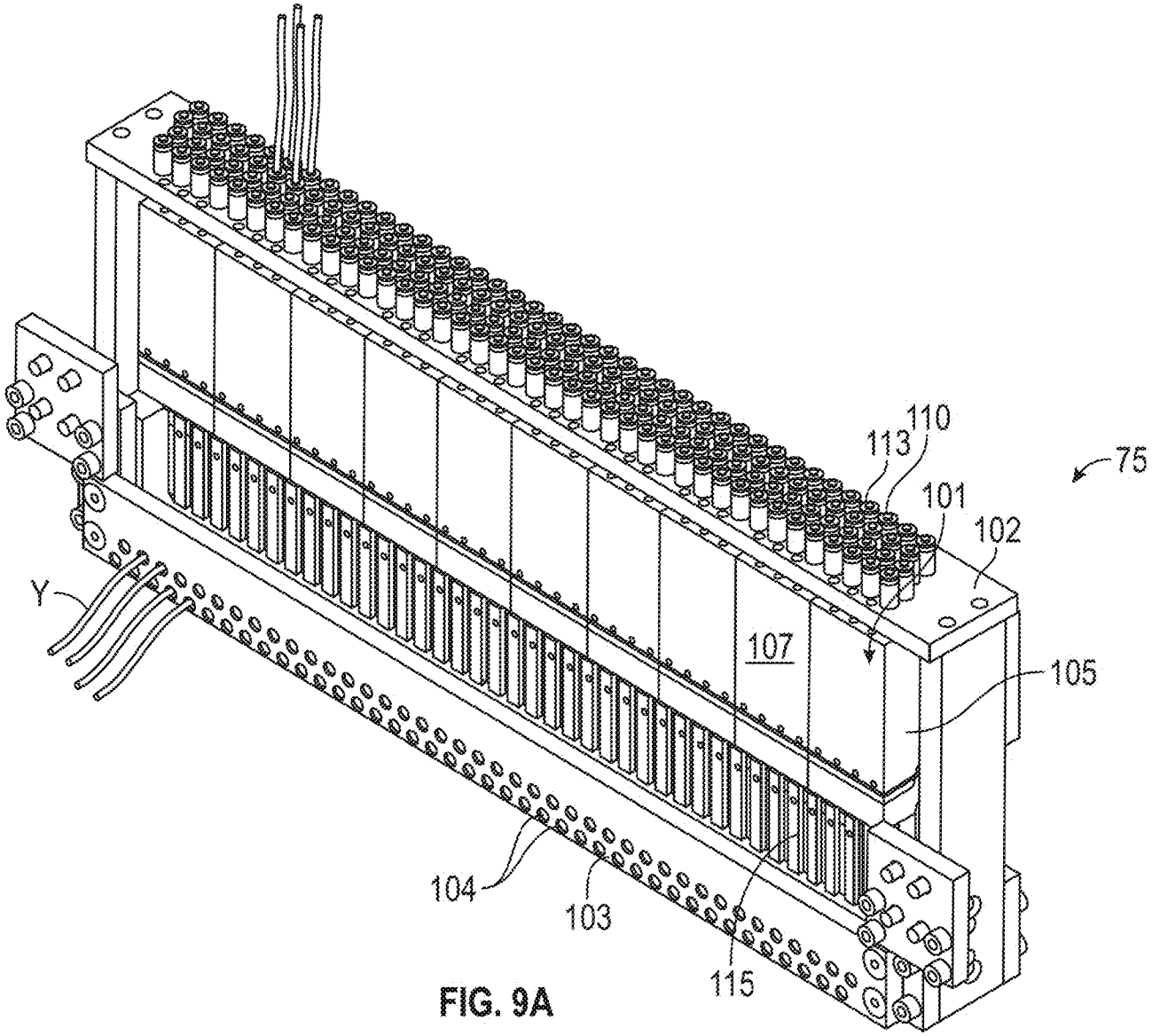
FIGS. 9A-9E illustrate an example of a yarn selector system, including a series of jerker modules, for selectively controlling feeding of yarns to the needles of a tufting system or apparatus according to the principles of the present disclosure.

As illustrated in FIG. 1A, a yarn selection system 75 for the hollow needle tufting machine 10 can be positioned along the path of travel each of the yarns from the yarn feed devices of the yarn feed system through the puller rolls into yarn feed conduits that feed the yarns to the needles. As illustrated in FIG. 9A, the yarn selection system 75 can be located adjacent the puller rolls 95, and, in embodiments, generally will include a plurality of jerker modules 101 that can be attached at their upper ends to a support plate 102 as part of a yarn jerker assembly or modular yarn jerker system that can be attached or mounted along the frame of the hollow needle tufting machine. A yarn feed guide 103 can be located adjacent the lower ends of the jerker modules, which can include a plurality of holes or openings 104 through which yarns are passed for guiding the individual yarns to the yarn conduits for feeding to the needles.

Figure 9B:
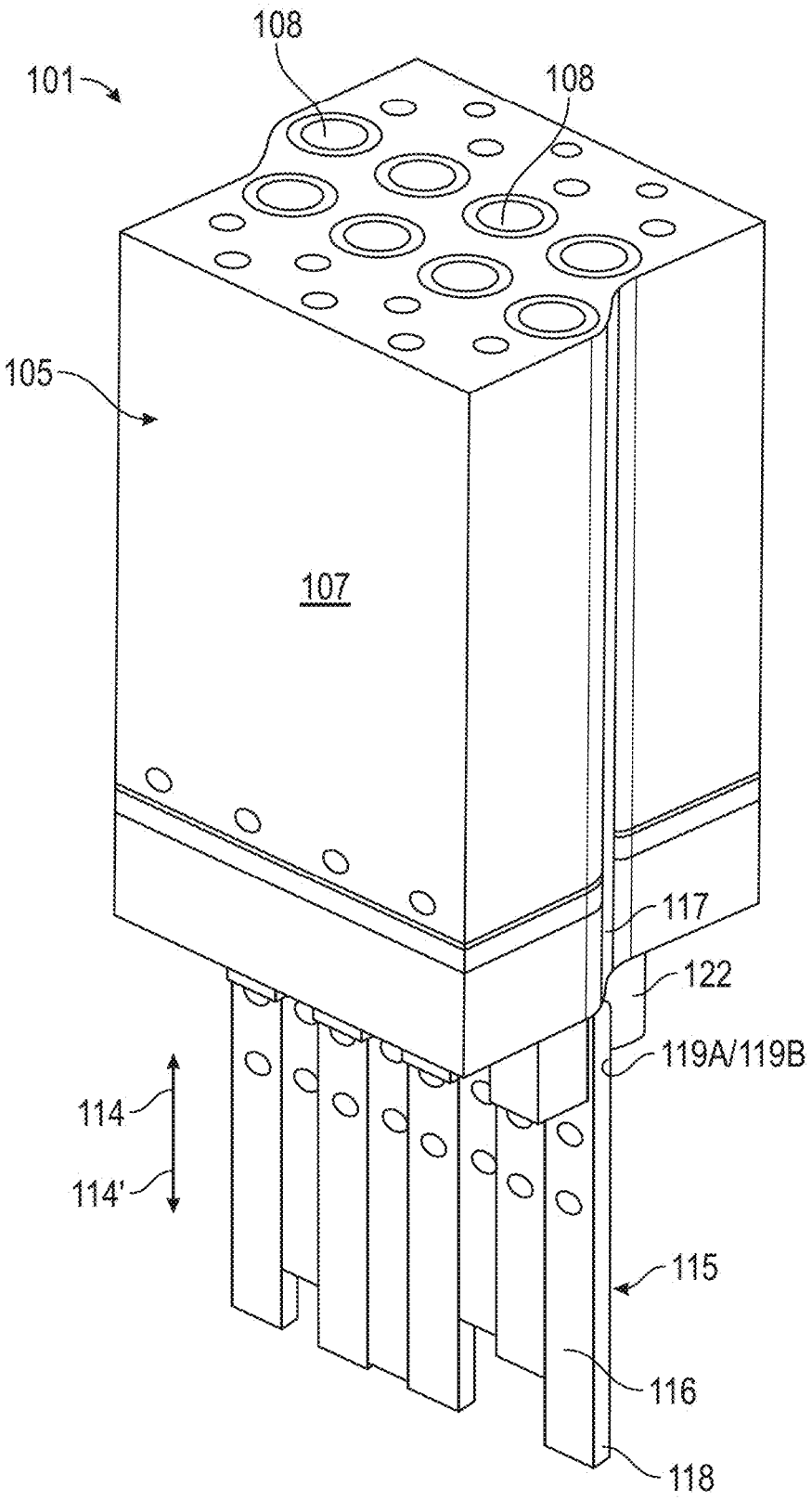
Figure 9C:
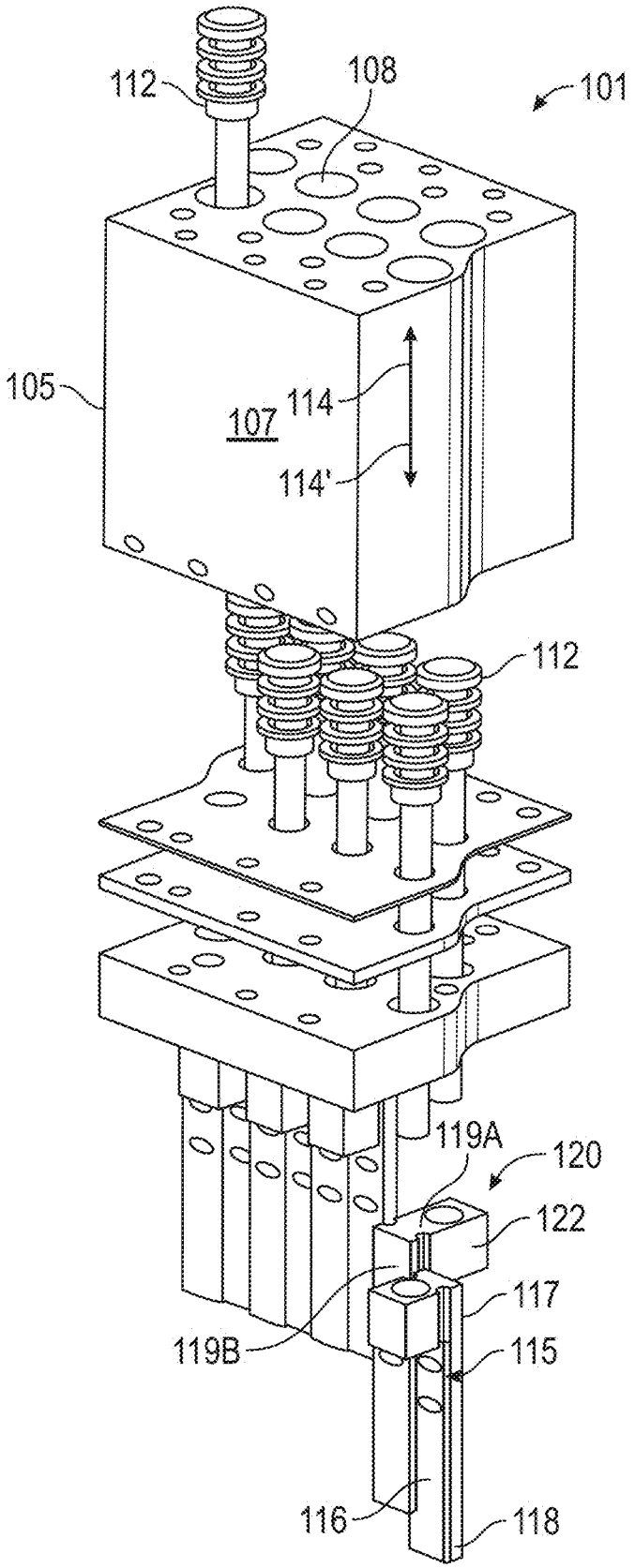
Figure 9E:
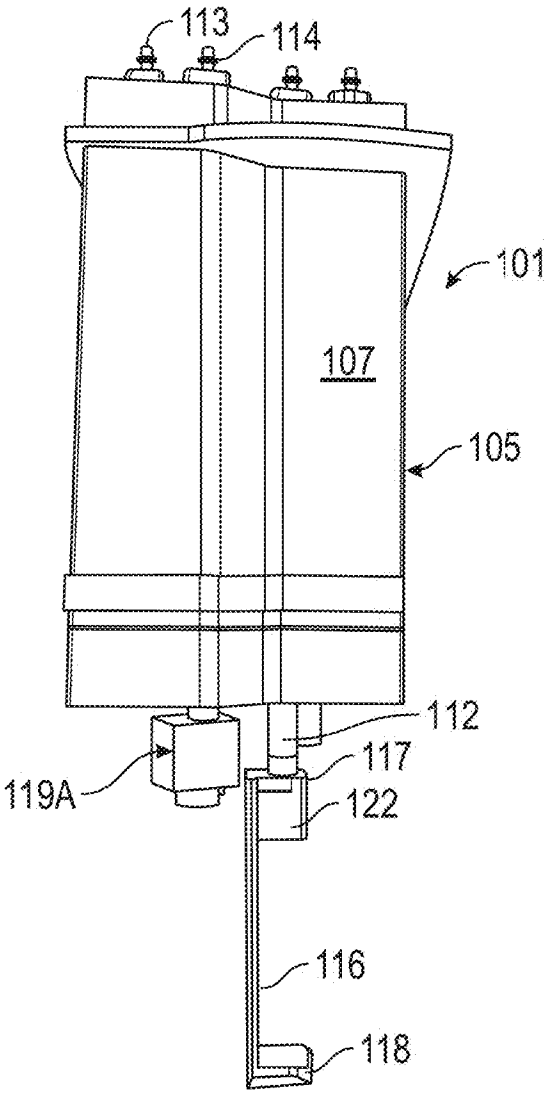
Figure 9D:
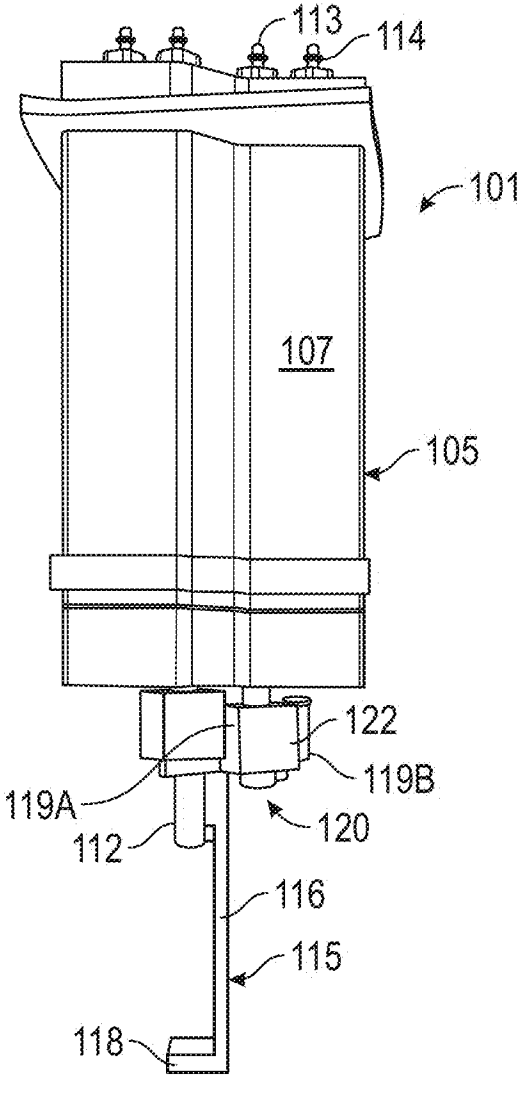

As shown in FIGS. 9C-9E, in embodiments, each of the jerker modules 101 can comprise a double acting cylinder 105 having a housing or cylinder body 107 in which a series of piston bores 108 and a series of air passages 109 are formed. Pistons 112 can be received within each of the piston bores. Air ports 113 (FIGS. 9A and 9B) can be connected to the upper ends of the piston bores. The air ports can include fittings or connectors connecting to air lines or conduits that are linked to the air supply (e.g., one or more blowers) that are configured for supplying flows of air to the double acting cylinders 105 from the air supply. The flows of air into the ports and into the individual piston bores of the double acting cylinders or the jerker modules can be controlled (e.g., increased or decreased) for selectively driving the pistons along the piston bores in first and second directions so as to cause jerkers 115 to be selectively moved between extended and retracted positions as indicated by arrows 114/114' in FIG. 9B. The jerkers 115 can engage individual yarns so that such yarns can be retracted or pulled back in conjunction with the control of the feeding of such yarns by the yarn feed devices to pull non-selected or unwanted yarns back and out of the funnels for the hollow needles.

In embodiments where the jerker modules comprise double acting cylinders, the jerker modules can be operated in conjunction with a valve 110, such as a multi-way valve, e.g., a four way solenoid valve or two to three air valves to apply a flow of pressurized air or other fluid through the air connections for driving the pistons along the path of travel in their first and second directions, without requiring a spring return for the pistons. For example, and without limitation, the air pressure can be controlled so that increased air pressure can be supplied to a first one of the ports sufficient to drive selected ones of the pistons along their piston bores in the first direction. For example, in embodiments, an increased air pressure can be provided sufficient to overcome a base or substantially constant air pressure supplied through the second port and through the air passages cylinder block that urges to the piston toward a retracted position, causing the jerkers to extend; and once such an increased pressure air flow is substantially halted or reduced, the pistons can be moved along a return stroke in their second direction to retract their associated jerkers.

The cylinder blocks or bodies 107 of the jerker modules further can be configured with a reduced profile, which enables an enhanced density of assigned placement of the jerker modules than the yarn selection assembly; e.g., in embodiments, the jerker modules can be arranged in groups or sets in which approximately 8 jerker modules can be positioned within a space of about two inches or less. Other arrangements and/or spacings of the jerker modules, including various numbers of jerker modules arranged in different spacings also can be used. In addition, the bores of the jerker modules can be reduced from approximately ½ inch to approximately 5/16th inch, which further enables more compact, denser design as illustrated in FIGS. 5 and 9A-9E.

In addition, in embodiments, the jerker modules also can be formed with a reduced weight, e.g., in embodiments, the jerker modules can be formed of lighter weight materials, such as aluminum or a composite material, e.g., nylon, carbon fiber polymers, and/or other moldable materials. In some embodiments, the yarn feed openings formed in the jerker modules also could be hard coat anodized or otherwise treated to facilitate movement of the yarns therethrough.

As indicated in FIGS. 9B-9E, each of the jerkers 115 generally can include an elongated body 116 having upper or proximal end 117 and a lower or distal end 118. In embodiments, such as shown in FIGS. 9D and 9E, the distal ends of jerkers can have hooked or angled configurations. Optionally, in other embodiments and as shown in FIGS. 9B-9C, the distal ends of jerkers can include a substantially straight or flat distal end. In embodiments, it is contemplated that the jerker modules further can include an anti-rotation mechanism or device 120 (FIGS. 9C and 10) configured for restricting or substantially preventing rotation or pivoting of the jerkers as they are moved along a stroke or path of travel between retracted and extended positions.

Figure 10:
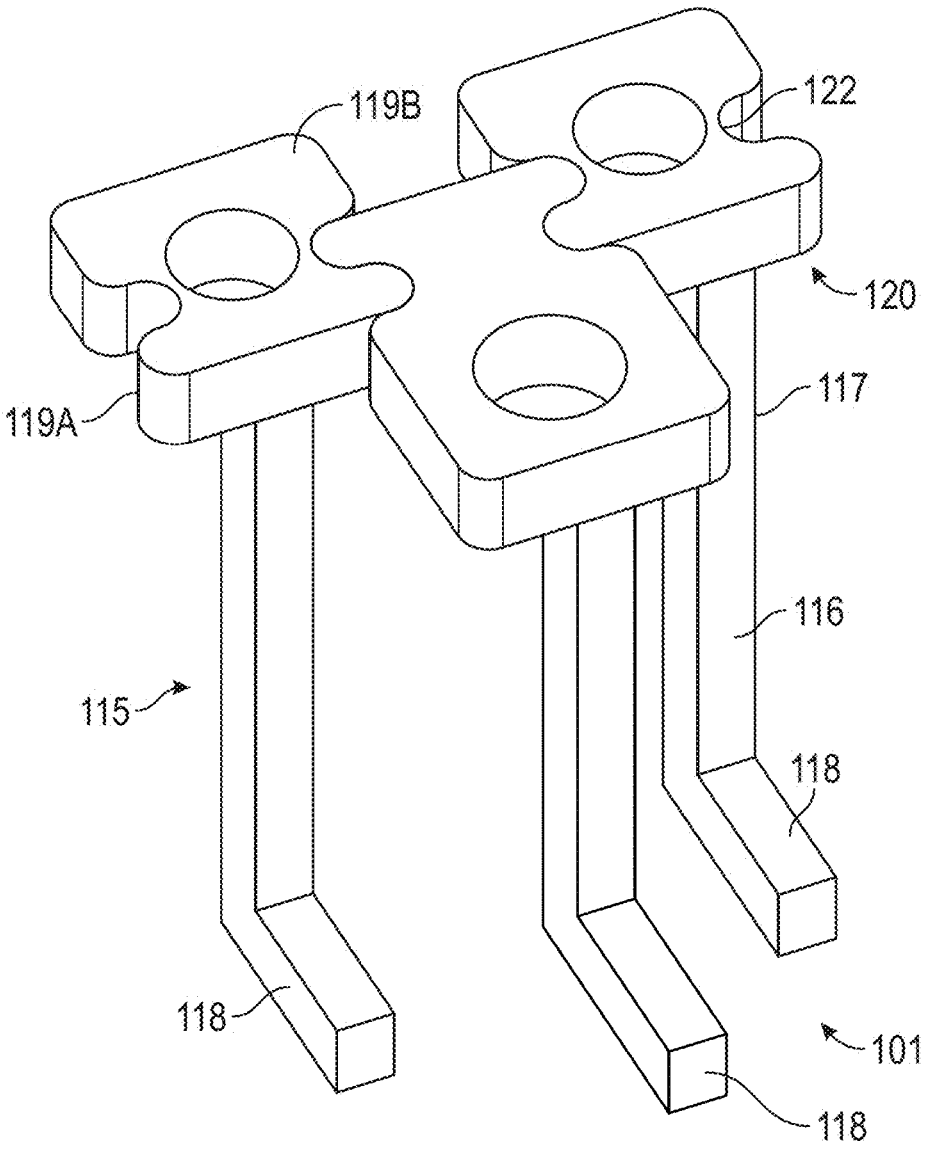
FIG. 10 shows an example embodiment of an anti-rotation device or mechanism for restricting rotation of the jerkers as they move along a stroke or path of travel according to the principles of the present disclosure.

In embodiments, the anti-rotation mechanism 120 can comprise interlocking keys at the proximal or upper ends of the jerkers. As indicated in FIGS. 9C and 10, the proximal ends 117 of the jerkers 115 can engage and lock together using the keys (e.g., alternating ones of the jerkers can include male or female keyways 119A/119B) so that the jerkers can cooperatively move in a substantially straight motion with respect to one another, with undue twisting or turning of the jerkers being substantially deterred, further enabling a more compact configuration and modularity of design. The male and female keyways of adjacent jerkers further act an anti-rotation device or mechanism, to restrict rotational or pivoting movement of the jerkers as they are extended and retracted.

In some embodiments, the anti-rotation mechanisms can include guide rods. The guide rods can be used, in addition to, or as an alternative to, the male and female keyways of the jerkers to help restrict rotation of the jerkers during their extension and retraction movements.

The jerkers further can be coupled at their proximal ends to an associated piston, as indicted in FIG. 9C, such as by a connector or gate key 119A/119B formed at the proximal end of each jerker. Each of the keys can include elongated head 122, and, in embodiments, can comprise a male or female key 119A/119B, and can include an opening through which a distal end of the associated piston 112 can be received and secured.

As further generally illustrated in FIGS. 12A-12B, the yarn cutting or knife system 21 can be arranged below the backing and along the tufting zone. In embodiments, the cutting or knife system 21 can include a series of knife modules 22 mounted along a knife bar 24, which will carry the knife modules and their knives in a reciprocating movement toward and away from the needles as the needles are reciprocated into and out of the backing. The knife modules also can be configured with a reduced profile and can be arranged along the knife bar at a similar gauge spacing to the spacing of the needles as indicated in FIG. 12B. Each of the knife modules 22 generally will include a knife or cutting blade 23 having a cutting edge 125 adjacent and upper end thereof. Each of the knives 12 can be received within a holder or support 126, with the knives generally being located or oriented such that their cutting edges 125 are aligned with the cutting edges or cutting surfaces of the needles, as indicated in FIGS. 7B-9C.

A knife alignment system, which, in embodiments, can include a plate assembly 130 provided along the knife bar for or locating the cutting edges of the knives with the cutting surfaces of the needles. The knives can be aligned via the plate alignment assembled and the fixed in place within their holders. Each of the knife modules can be mounted along the knife bar rather than the knives having to be individually mounted along the hollow needle tufting machine. In embodiments, the knife bar further can incorporate the alignment plate assembly so that the knives can be mounted in the hollow needle tufting machine and the plate assembly then can be used to align or set the knives to a desired or selected cutting angle with respect to the alignment or orientation of the cutting surfaces of their respective or associated needles. For example, in embodiments, the cutting edges of the knives can be set to a zero degree cutting angle with respect to the cutting surfaces of the needles, though other cutting angles also can be used as needed, to ensure proper cutting engagement or contact with the cutting surfaces of the needles. Adjustment of the knife location and/or orientation can further enable adjustment of the knife pressure of the engagement between the knives and the cutting surfaces of the needles.

Each of the knife modules further generally will include an actuator, such as air cylinder 121. In embodiments, the actuators of the knife modules generally can comprise multi-position actuators or cylinders. The multi-position actuators will each receive a flow of pressurized air from the air supply of the hollow needle tufting machine, under control of the control system, for selectively moving each of the knives between a series of positions. The position of the knives can be controlled so that the knives can be moved between a lowered or no-cut position, wherein loop pile tuft of selected yarn can be formed in the backing in accordance with the pattern of the tufting article being formed, and a plurality of raised cutting positions or elevations for cutting yarns implanted or delivered into the backing by the needles to form cut pile tufts. Such tufts further can be formed at varying pile heights.

For example, in embodiments, the multi-position actuator can include a 3-position actuator such as a 3-position pneumatic or hydraulic cylinder or a servo or stepper motor (or other actuator), and further can include a 4-way fluid valve for selectively controlling a supply of fluid (e.g., air) to the 3-position actuator. In embodiments, at least three positions for each of the knives can be provided, e.g., a high cut position, low cut position, and a no cut or loop position.

Positioning or location of the knives between their no-cut and cutting positions can be controlled by the system control in cooperation with the delivery of selected yarns to each of the needles to form such cut and loop pile tufts, as well as for forming varying pile height tufts in accordance with the pattern of the tufted article being formed. In addition, solenoids can be provided for controlling feeding of air to each of the cylinders driving movement of the knives. A pressurized air supply can be coupled to the cylinders of each of the knife modules supplying a flow of pressurized air thereto, which flow of air can be controlled by the solenoids or other actuators to control movement of the knives.

During each tufting cycle, the knife blades can be configured to cooperate with the needles by sliding over the respective tips of the needles in a shearing-like action to cut the yarn that is inserted or implanted by the needles. Thus, when one or more of the knives are moved into a position in which their cutting edges are raised to a cutting position, the cutting edge of each of such one or more knives can contact the cutting surfaces of their associated needles when the needles are reciprocated into the backing to form cut pile tufts in the backing. Conversely, when one or more knives are moved into a position in which a distal end thereof is farthest from the tip and cutting edge of an associated needle, i.e., the non-engaging or no-cut position, the cutting edges of the one or more knives will not make contact or will not make sufficient contact with the cutting surfaces of an associated needle when the needle reciprocated into the backing, thus allowing a loop pile tuft to be formed in the backing.

In addition, in embodiments, the backing support or shuttle can be shifted transversely to the direction of feeding of the backing along its path of travel through the hollow needle tufting machine. In embodiments, as indicated in FIGS. 2A and 2B, a shift mechanism 38 can be coupled to the backing support or shuttle 18 and can be controlled to shift or move the backing transversely with respect to the path of travel P (FIG. 2A) of the backing 14 through the hollow needle tufting machine 10. In addition, in embodiments, multiple shift mechanisms can be used (e.g., positioned on opposite sides of the hollow needle tufting machine); and, in some embodiments, one or more shift mechanisms can be coupled to the needle bar for shifting the needles 12 separately from and/or in conjunction with the backing support or shuttle, to form a tufted pattern.

In embodiments, the shift mechanism(s) can include shift mechanisms driven by one or more servo motors, or other actuators under control of the control system 30. For example, one or more shift mechanisms 38, including, in embodiments, a servo motor driven rack and pinion sift mechanism such as a SmartTech™ shift mechanism as produced from Card-Monroe Corp. of Chattanooga, TN, can be provided for shifting the backing bar transversely.

In embodiments, the backing can be shifted in steps of one or more gauges. The modular design of the needle modules of the hollow needle tufting machine and the use of the reduced profile jerker modules of the yarn selection system can enable eight or more yarns to fed to each needle, with each needle spaced approximately with one inch gauge spacing. As a result, shift steps or jumps based on a gauge spacing of the needles, e.g., one or more steps or jumps for implanting 8, 16, 24, etc . . . different colors and/or types of yarns, within an approximately 1" stitch gauge, versus conventional hollow needle machines that can require at least two or more jumps or steps for presenting or implanting 8, 16, 24, or more yarns.

In addition, in some embodiments, a shift mechanism could be provided for shifting the needles. For example, a shift mechanism can be coupled to the needle bar and controlled by the control system for shifting the needles with respect to the backing.

Optionally and as shown in FIGS. 2A, 3A-3B, and 4, one or more presser feet 13 can be disposed adjacent the needles transversely across the hollow needle tufting machine 10 and slightly above the backing to help prevent the needles from raising the backing when the needles are removed from the backing during a tufting cycle. The one or more presser feet can be connected to an elongated rail member, which can be connected to the underside of the frame 11 with arms to fix the presser feet to the frame 11.

The control system 30 (FIG. 2B) of the tufting hollow needle tufting machine 10 can include one or more processors and a memory. In embodiments, the control system 30 can receive programming or instructions from an operator and/or a pattern file input (separate from the operator instructions) for making a particular tufted article such as a patterned carpet. In other embodiments, the control system can include programming or instructions for forming tufted patterned articles stored in the memory. In use, as further described herein, the control system can control the various subsystems of the tufting apparatus, including feeding of the backing, reciprocation of the needles based on or in view of the operational speed of the hollow needle tufting machine (e.g., rotation of the main shaft), selective engagement of the knives of the yarn cutting or knife system, and feeding of the yarns to the needles by the yarn feed system. The control system further can control shifting of the backing (and, in some embodiments, shifting of the needles) in accordance with the stored or received instructions to make the desired product.

As indicated in FIG. 2B, in embodiments, the control system 30 can comprise include a controller 31 that can be linked to a control interface 32, and which, in some embodiments, can be provided in a control cabinet connected to or incorporated with the hollow needle tufting machine. For example, as indicated in FIG. 2B, in embodiments, the controller 31 can be housed in a control cabinet located adjacent the hollow tufting machine and linked thereto; or can be supported on the frame of the hollow needle tufting machine, or otherwise incorporated with the hollow needle tufting machine.

In embodiments, the controller 31 of the control system 30 can be linked to the operative systems or components of the hollow needle tufting machine, such as a being linked to various controllers/control systems therefor. For example, the controller 31 of the control system 30 can be linked to at least one of a backing feed controller 33 for controlling the motors driving the feeding of the backing through the tufting zone, one or more yarn feed controllers 34 for controlling the yarn feed devices of the yarn feed system for to control the feeding of each of the yarns to the needles as needed to form the tufted pattern, a yarn cutting or knife system controller 36 to control action of selected ones of the knives thereof; and further can be linked to and can control of the shift mechanism(s) for shifting the needle bar and/or shifting the backing. In embodiments, the controller 31 can receive pattern inputs and display operating conditions from each of the operative elements or components.

The various controllers and the operator interface can comprise at least one computing device (such as a personal computer, a laptop computer, a tablet, a smartphone, a programmable logic controller, a programmable automation controller, at least one servo drive, at least one hardware interfacing device, and the like) that is programmed with an operator utility software and run time software and generally stores yarn color pattern information and controls operation of the yarn feed devices of the yarn feed system in accordance with the selected multi-colored tufted pattern.

The control system 30 can control and coordinate operation of the operative systems or components of the hollow needle tufting machine 10 for driving the backing transport system 16, the needle bar drive system via the main drive shaft 42, and the yarn feed devices of the yarn feed system, shifting of the needles and/or backing, etc. in cooperation to form patterns having multi-colors and/or multi-type yarn. For example, a sensor, such as an encoder or other, similar sensor configured to monitor rotation of the main drive shaft, can be used to generate data representing the position and speed of movement of the main drive shaft and communicate such data to the control system 30, which data can be used by the control system to control operation of one or more of the controllers for operative elements, such as, for example, the yarn feed system (including individual yarn feed devices in embodiments), the cutting assembly, yarn selection system, and one or more shift mechanisms, based on a position of the main drive shaft.

The control system programming or instructions also can include functions such as selecting pattern files from a pattern input such as a stored pattern file, decompressing or compressing pattern files, changing pattern colors, setting up the yarn creel, and performing diagnostic functions with the yarn control input/output. Optionally, patterns such as multi-colored patterns for carpet can be scanned using a conventional multi-color pattern scanning device, translated into a pattern file, and downloaded onto a disk, flash drive, or the hard drive of the controller 31 or the control system. The operator can input instructions through the operator control interface 256 for the timing of the tufting operation.

In an operation of the hollow needle tufting machine, the controller 31 of the control system 30 can receive pattern information, such as the network connection, disc or other input from an operator through the operator interface, or can be instructed to run a pattern that has been programmed and stored into its memory. The hollow needle tufting machine 10 generally can be operable to produce multi-colored, patterned tufted articles, such as carpets, rugs, artificial turf or grass or other tufted articles, and can deliver at least eight different color or type yarns to each needle, with the needles being arranged at a spacing or gauge spacing for approximately one inch. The hollow needle tufting machine further can be operable to form tufted patterns utilizing more than eight different color type yarns, e.g., 16 or 24 different color patterns also can be formed. In addition, the hollow needle tufting machine can produce patterned tufted articles, such as carpets, having both cut pile tufts and loop pile tufts, and, in embodiments, cut pile tufts and loop pile tufts can be arranged to form separate or independent patterns or sections of an overall pattern. Still further, the hollow needle tufting machine can produce tufted articles having varying pile heights of tufts, which can provide various texturing effects.

To form a selected multicolored tufted pattern, the backing will be fed through the tufting zone at a controlled rate, e.g., being fed at discrete steps or incremented movements, as the needles are reciprocated into and out of the backing. The yarn feed devices of the yarn feed system can be selectively controlled so that a series of different color or texture yarns can be selectively fed to each of the needles in order to feed the desired color or type of yarns for each selected stitch of the pattern to each of the needles, while restricting the feeding of non-selected yarns (e.g., yarns not to be tufted for such a stitch locator). In conjunction with the control of the yarn feed to the needles, jerkers of the yarn selection system are configured to be cooperatively controlled so as to extend or retract to selected ones of the jerkers, which engage and pull back or allow feeding of from ones of the yarns.

For example, for yarns that are to be fed for placement into the backing, selected ones of the jerkers associated with such selected yarns can be extended so as not to interfere with the feeding of the yarns to the needles. Other ones of the jerkers associated with non-selected yarns can be retracted, so as to engage and pull back the non-selected yarns, causing the non-selected yarns to be removed from the funnels of their corresponding or assigned needles. In addition, the control system can control shifting of the needles according to the pattern, in operative cooperation with the feeding of the yarns, operation of the jerkers, and feeding of the backing material. Further, the control system can control movement of individual ones of the knives and below the tufting zone so as to position individual or selected ones of the knives in various positions, including a no-cut position for forming loop pile loops or tufts, and various cutting positions for forming cut pile tufts.

In addition, in embodiments, air conduits also can be provided that can communicate with the injectors for each of the needles. In embodiments, pressurized air can be blown through the air conduits by corresponding tubes connected to the pressurized air supply and can be directed through the conduits and into the needle bores as the needles are withdrawn from the backing. This flow of pressurized air can force a cut end of yarn, which generally forms a last backstitch and which is no longer connected to the needle, down into the backing as the needle makes a subsequent opening. Such an operation can, in embodiments, be performed in cooperation with the operation of the jerkers of the yarn selection system, to substantially pull back non-selected yarns from the needles. This further can eliminate excess yarn on the rear of the backing and preclude the yarn from forming a backstitch raised above the surface of the backing material. Optionally, each yarn feed conduit can be disposed at an angle relative to the axis of a respective one of the needles.

Still further in embodiments, operation of the various operative systems or components of the hollow needle tufting machine can be dynamically cooperatively controlled. In some such embodiments, timing of an initiation of the operation of various operative systems or components that can be based upon the machine speed or rotational rate (RPM) of the main shaft of the hollow needle tufting machine can be advanced. The system control can be provided with instructions or programming that may include determined or programmed dynamic advance parameters for each of the operative systems or components of the hollow needle tufting machine.

For example, at an initial machine speed or RPM, extension or retraction of selected jerkers can be advanced based on a position or the rotation of the main drive shaft, while initiation of other operative components, such as turning an air blower on to supply air to the jerker modules and to into the knife modules for movement of the knives to a desired cutting or to a no-cut position, and starting and stopping of the yarn feed drives for each of the yarns also can be determined. Additional dynamic advance parameters can be determined for advancing the operation of such operative systems or component at other, differing machine speeds. In embodiments, some dynamic advance parameter values can be pre-determined and stored in the memory of the system control, and, in embodiments, dynamic advance values parameter can be checked by the systems control and/or used as initial or guide parameter values for selected machine operating speeds.

The system control thereafter can determine or interpolate adynamic advance for the various selected operative systems or components of the hollow needle tufting machine as the hollow needle tufting machine is run or operated at different machine speeds to enable and enhanced precision and consistency of operation of the hollow needle tufting machine even as the operational speed varies. As a result, even if the operating speed of the hollow needle tufting machine is varied, for example, as the machine is started and goes from an initial or jog mode up to a full desired operating speed, the operative systems or components, such as the jerkers, air blower(s), knife, modules, yarn feed drivers, and/or other components, can be controlled so as to advance their operation as needed to ensure consistent operation of the machine and consistent production of the pattern tufted articles being produced thereby at substantially any operational speed of the machine.

In addition, in embodiments, the control system can include programming configured to control flows or pressurized air to various operative components, such as, e.g., one or more of the jerker modules and/or other components to be supplied with pressurized air flows, so as to selectively turn on/off the flows of pressurized air to groups or individual ones the jerker modules and/or other components. For example, in embodiments, the pressurized air flows supplied to sections or groups of the jerker modules and/or other components can be shut off when certain non-selected yarns (e.g., yarns of a particular color or type) are not being used in the pattern being tufted, to enable a reduction in air consumption. In addition, in some embodiments, programmable regulators or valves can be used to control pressurized air flows to the various operative components. Such regulators can include programing including, for example, preset on/off or starting and stopping parameters, volumes of air to be supplied, and other parameters based on a particular pattern to be tufted. In embodiments, such preset parameters can be incorporated into and/or stored as part of a pattern file for the pattern.

Figure 12A:
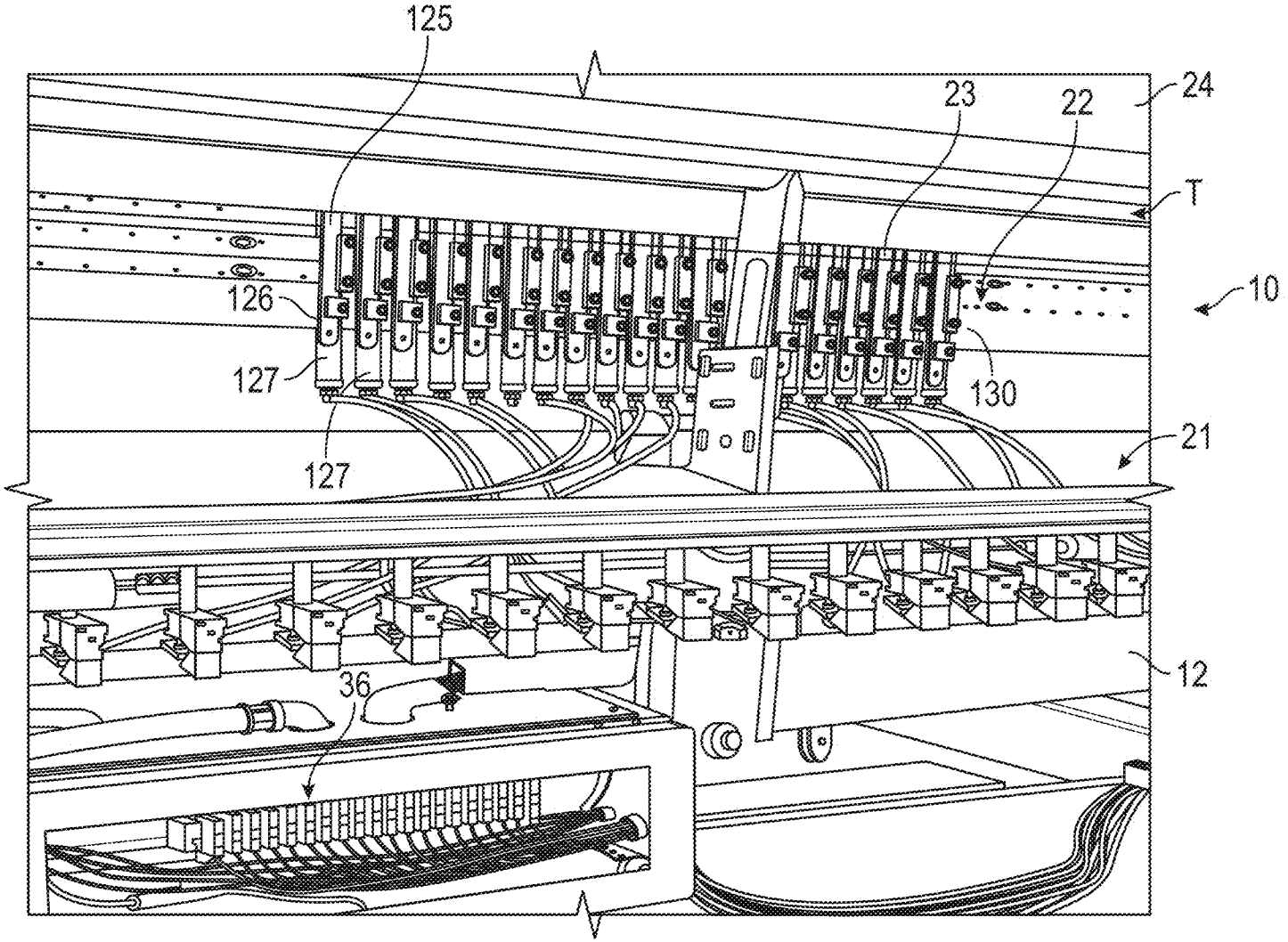
FIGS. 12A-12B illustrate an example embodiment of a yarn cutting or knife system for a tufting system or apparatus according to principles of the disclosure.
Figure 12B:
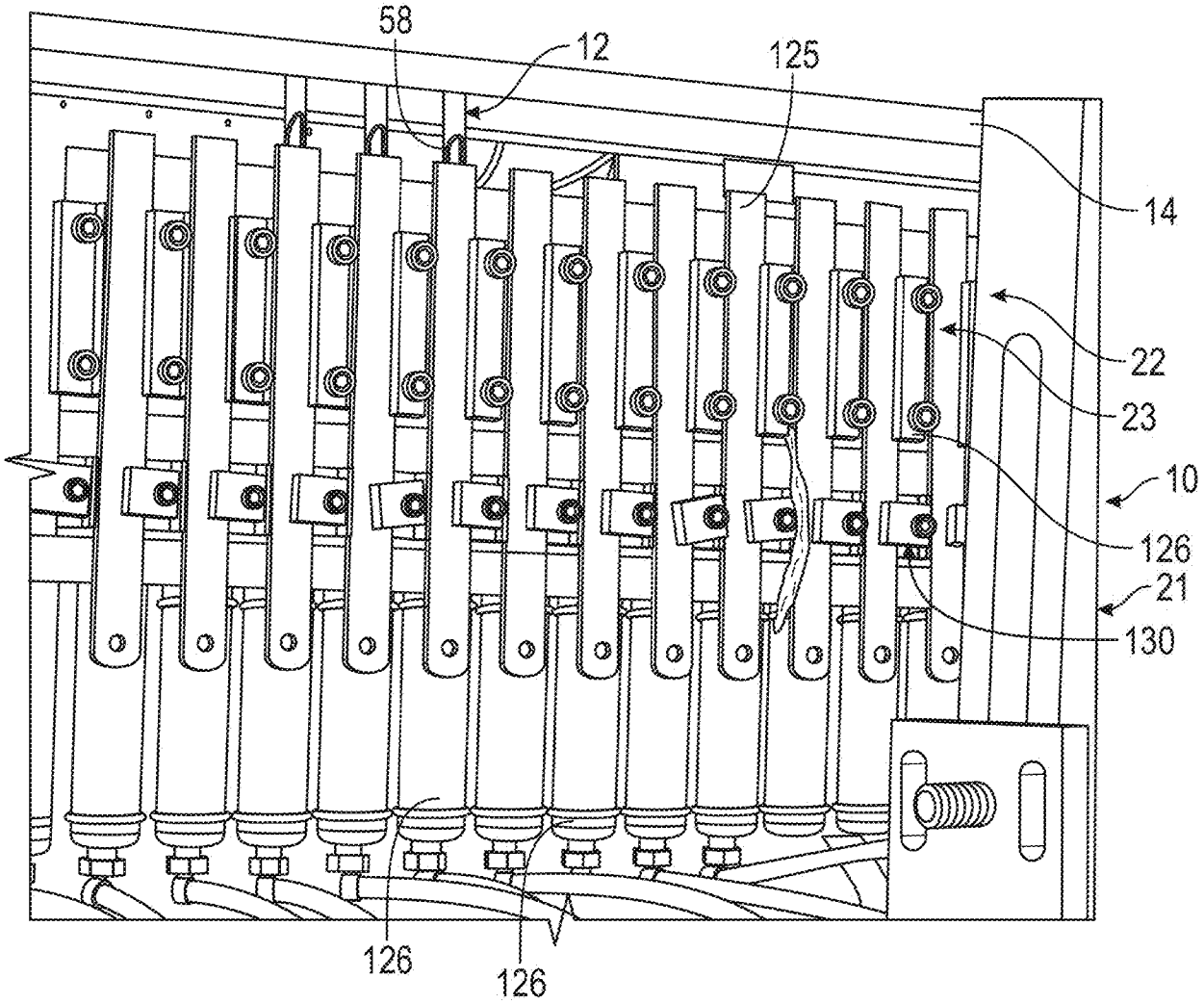

As shown in FIGS. 12A-12B, in embodiments, the yarn cutting assembly or knife system can be arranged along the tufting zone, positioned below the backing support or shuttle and the backing 14, and can comprise one or more knife assemblies. In embodiments, the knife assemblies can include modules with multiple knives therein, while in other embodiments, the knife assemblies can comprise individual knives having an actuator coupled thereto.

The present disclosure has been described herein in terms of examples that illustrate principles and aspects of the present disclosure. The skilled artisan will understand, however, that a wide gamut of additions, deletions, alterations, and modifications, both subtle and gross, may be made to the presented examples without departing from the spirit and scope of the present disclosure. All such modifications which do not depart from the spirit of the disclosure are intended to be included within the scope of any of the aspects and/or claims provided by the present disclosure.

We claim:

1. A tufting machine, comprising:

a plurality of needles configured to penetrate a backing;

wherein the needles comprise hollow needles, each having an upper end and a lower end, with a passage defined between the upper end and the lower end;

a yarn feed system for supplying a plurality of yarns to the needles;

a yarn selection system positioned between the yarn feed system and the needles;

a plurality of funnels in communication with the needles;

wherein the yarn selection system is coupled to an air supply and configured to deliver selected yarns of the yarns supplied by the yarn feed system to one or more of the funnels;

wherein the funnels are configured to direct the selected yarns into the needles; and a cutting assembly arranged below the needles and including one or more knives configured to cut the selected yarns as selected yarns are carried into the backing with reciprocation of the needles into and out of the backing; and wherein the needles are arranged at a gauge spacing of approximately 1" or less.

2. The tufting machine of claim 1, wherein the yarn selection system comprises a plurality of jerkers each moveable between an extended position and a retracted position for pulling back non-selected yarns.

3. The tufting machine of claim 2, further comprising a control system comprising programing configured to dynamically advance operation of the yarn feed system and the jerkers ahead of a next stitch placement step of a pattern being formed.

4. The tufting machine of claim 1, wherein the tufting machine is configured to produce artificial turf or grass.

5. The tufting machine of claim 1, wherein the yarn selection system comprises at least one jerker module including a plurality of bores and a plurality of jerkers received within the plurality of bores; and wherein each of the jerkers is moveable between a retracted position and an extended position in response to selective control of air flows though the bores to pull back or allow feeding of the yarns to the needles.

6. The tufting machine of claim 5, further comprising guides positioned adjacent the jerkers.

7. A method of operating a tufting machine, comprising:

moving a backing across a backing support;

reciprocating a series of hollow needles into and out of the backing, the hollow needles carrying a series of yarns;

feeding selected colors or types of yarns through the hollow needles as the hollow needles are reciprocated into the backing for forming of tufts of the selected colors or types of yarns in the backing; and wherein feeding the selected colors or types of yarns comprises moving a series of jerkers between a retracted position and an extended position to hold or pull back non-selected colors or types of yarns and to allow feeding of the selected colors or types of yarns to the hollow needles.

8. The method of claim 7, further comprising cutting the selected colors or types of yarns.

9. The method of claim 7, further comprising advancing the feeding of the selected colors or types of yarns by a yarn feed system and initiating movement of the jerkers between their extended and retracted positions ahead of a next stitch placement step of a pattern being formed based on rotation of a main drive shaft of a tufting machine.

10. The method of claim 7, further comprising shifting the backing support, shifting the hollow needles, or a combination thereof, transversely with respect to a path of travel of the backing through a tufting zone of the tufting machine.

11. The method of claim 7, wherein moving the backing comprises feeding the backing at increments through the tufting machine.

12. A tufting machine, comprising:

a backing support over which a backing is moved;

a plurality of hollow needles;

a yarn feed system for supplying a plurality of different colors or types of yarns to each of the hollow needles;

a yarn selection system including:

a plurality of jerkers positioned between the yarn feed system and the hollow needles;

wherein the jerkers are operable to selectively pull back or allow feeding of the different colors or types of yarns to the hollow needles; and a series of injectors configured to direct selected colors or types of yarns into the hollow needles; and wherein the hollow needles are configured to penetrate the backing to deliver the selected colors or types of yarns into the backing for forming tufts of the different colors or types of yarns in the backing in accordance with a pattern being tufted.

13. The tufting machine of claim 12, further comprising a cutting assembly positioned below the backing support, the cutting assembly including one or more knives configured to cut the selected colors or types of yarns carried into the backing with the penetration of the hollow needles into the backing, and one or more actuators configured to selectively move the one or more knives between an engaging position for cutting the selected colors or types of yarns and a non-engaging position.

14. The tufting machine of claim 13, wherein the cutting assembly further comprises a plurality of knife modules within which at least one knife received; wherein the one or more actuators comprise at least one actuator coupled to each of the knife modules and in communication with the knives; and wherein the actuators are selectively actuable to control movement of each of the knives between a retracted position and a cutting position.

15. The tufting machine of claim 12, further comprising a control system including programming configured to control feeding of different lengths of the selected colors or types of yarns during a rotation of a main drive shaft of the tufting machine.

16. The tufting machine of claim 12, further comprising at least one shift mechanism connected to the backing support or to at least needle bar along which the hollow needles are positioned and configured to move the backing support or the needle bar transversely so as to shift the backing or the backing or the hollow needles transversely with respect to a path of travel of the backing.

17. The tufting machine of claim 12, further comprising a plurality of funnels located between the injectors and the hollow needles.

18. The tufting machine of claim 17, wherein each of the funnels comprise an inlet including a first portion having a first diameter and a second portion having a second diameter that is different from the first diameter, and an outlet in communication with at least one of the hollow needles.

19. The tufting machine of claim 12, wherein the tufting machine is configured to produce artificial turf or grass.

20. The tufting machine of claim 12, wherein the yarn selection system comprises at least one jerker module within which a series of jerkers are received; and wherein the jerkers are each moveable through the at least one jerker module between a retracted position and an extended position to selectively pull back or feed the yarns.

* * * * *